US007071962B2

(12) United States Patent
Fujii et al.

(10) Patent No.: US 7,071,962 B2
(45) Date of Patent: Jul. 4, 2006

(54) ELECTROPHOTOGRAPHIC APPARATUS, PROCESS CARTRIDGE AND ELECTROPHOTOGRAPHIC PHOTOSENSITIVE MEMBER UNIT

(75) Inventors: Atsushi Fujii, Kanagawa (JP); Masato Tanaka, Shizuoka (JP); Ryuji Higashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 10/842,488

(22) Filed: May 11, 2004

(65) Prior Publication Data

US 2004/0207716 A1 Oct. 21, 2004

Related U.S. Application Data

(63) Continuation of application No. PCT/JP03/15395, filed on Dec. 2, 2003.

(30) Foreign Application Priority Data

Dec. 2, 2002 (JP) ..... 2002-349401

(51) Int. Cl.
*B41J 2/435* (2006.01)

(52) U.S. Cl. ..... 347/248; 347/234

(58) Field of Classification Search ..... 347/234, 347/240, 248, 251, 254, 228, 262, 264, 169; 250/201.4; 430/59.6; 346/138
See application file for complete search history.

(56) References Cited

U.S. PATENT DOCUMENTS

| | | | | |
|---|---|---|---|---|
| 5,055,663 | A * | 10/1991 | Morimoto et al. | 250/201.4 |
| 5,126,800 | A | 6/1992 | Shishido et al. | 399/111 |
| 5,208,634 | A | 5/1993 | Ikemoto et al. | 399/111 |
| 5,218,405 | A | 6/1993 | Wong | 399/117 |
| 5,345,294 | A | 9/1994 | Nomura et al. | 399/90 |
| 5,623,328 | A | 4/1997 | Tsuda et al. | 399/111 |
| 5,828,928 | A | 10/1998 | Sasago et al. | 399/111 |
| 6,465,143 | B1 | 10/2002 | Tanaka et al. | 430/59.3 |
| 2002/0025483 | A1 * | 2/2002 | Kawamura et al. | 430/59.6 |

FOREIGN PATENT DOCUMENTS

| | | | |
|---|---|---|---|
| EP | 0 577 318 A2 | | 6/1993 |
| JP | 6-67581 | | 3/1994 |
| JP | 9-240051 | | 9/1997 |
| JP | 2000-227736 | | 8/2000 |
| JP | 3254833 | | 11/2001 |
| JP | 2002-62762 | | 2/2002 |
| JP | 2002062762 A | * | 2/2002 |
| JP | 2002-91043 | | 3/2002 |
| JP | 2002091043 A | * | 3/2002 |

* cited by examiner

*Primary Examiner*—Hai Pham
(74) *Attorney, Agent, or Firm*—Fitzpatrick, Cella, Harper & Scinto

(57) ABSTRACT

An electrophotographic apparatus has a beam spot made to have a small spot diameter by the use of a laser having an oscillation wavelength within the range of from 380 nm to 450 nm, and enables image reproduction at ultra-high resolution and with ultra-high image quality. The apparatus includes I) an electrophotographic photosensitive member unit having i) an electrophotographic photosensitive member having a photosensitive layer on a cylindrical support and ii) fitting members fitted to the end portions of the electrophotographic photosensitive member, and II) an exposure device having a laser having an oscillation wavelength within the range of from 380 nm to 450 nm, and in which a spot diameter Di (μm) of a beam spot formed on the surface of the electrophotographic photosensitive member by a laser beam emitted from the laser is 40 μm or less, and the cylinder deflection De (μm) of the electrophotographic photosensitive member unit is 1.5 times or less the spot diameter Di (μm) of the beam spot.

6 Claims, 6 Drawing Sheets

ELECTROPHOTOGRAPHIC APPARATUS, PROCESS CARTRIDGE AND ELECTROPHOTOGRAPHIC PHOTOSENSITIVE MEMBER UNIT

CROSS-REFERENCE TO RELATED APPLICATION

This application is a continuation of International Application No. PCT/JP03/15395 filed on Dec. 2, 2003, which claims the benefit of Japanese Patent Application No. 2002-349401, filed on Dec. 2, 2002.

BACKGROUND OF THE INVENTION

1. Field of the Invention

This invention relates to an electrophotographic apparatus, a process cartridge and an electrophotographic photosensitive member unit.

2. Related Background Art

Various systems such as an electrophotographic system, a thermal-transfer system and an ink-jet system have conventionally been employed in image forming apparatus. Of these, an image forming apparatus employing the electrophotographic system, what is called an electrophotographic apparatus, has superiority to image forming apparatus employing other systems, in view of high speed, high image quality and noiselessness.

In addition, not only monochrome electrophotographic apparatus, but also polychrome (color) electrophotographic apparatus (color electrophotographic apparatus) have become popular.

Various systems are employed in such color electrophotographic apparatus. For example, well known are an intermediate transfer system in which exposure and development are successively performed for each color by means of a single electrophotographic photosensitive member, and respective color toner images are primarily sequentially transferred onto an intermediate transfer member (such as an intermediate transfer drum or an intermediate transfer belt), where the toner images thus transferred are thereafter secondarily transferred in a lump onto a transfer material to form a color image; an in-line system in which respective color toner images are respectively formed in respective color image forming sections disposed in series (each having an electrophotographic photosensitive member, a charging means, an exposure means, a developing means, a transfer means and so forth), and the toner images thus formed are sequentially transferred to a transfer material transported to the respective image forming sections in turn, to form a color image; and a multiple transfer system in which exposure and development are successively performed for each color by means of a single electrophotographic photosensitive member, and respective color toner images are sequentially transferred onto a transfer material (such as paper) held on a transfer material carrying member (such as a transfer drum), to form a color image.

Now, in recent years, various approaches have been taken because of an increasing need for the achievement of ultra-high resolution and ultra-high image quality with respect to the electrophotographic apparatus. Among various approaches, the relationship between an electrophotographic photosensitive member and an exposure means for forming an electrostatic latent image on the surface of the electrophotographic photosensitive member is considered to be particularly important because it is the basis of image formation. For example, Japanese Patent No. 3254833 (Patent Document 1) discloses, in a system making use of a laser beam as exposure light (imagewise exposure light), the relationship between the writing pitch of the laser beam and the total deflection of a cylindrical electrophotographic photosensitive member (photosensitive drum).

But, however fine the writing pitch of the laser beam, images with ultra-high resolution and ultra-high image quality are not obtainable unless a beam spot formed on the surface of the electrophotographic photosensitive member by a laser beam has a small spot diameter (beam-spot diameter).

A beam spot formed on the surface of the electrophotographic photosensitive member by a laser beam emitted from a laser of around 780 nm in oscillation wavelength (a near infrared semiconductor laser), having conventionally been used as an exposure light source of electrophotographic apparatus, has a spot diameter of about 100 μm, the limit of which is about 50 to 80 μm whatever improvements are made on various optical members.

Even if improvements on various optical members have made the beam spot have a small spot diameter, it is difficult to obtain the sharpness of the contour of the beam spot. This is known from the diffraction limit of laser beams that is represented by the following equation (1). The following equation (1) shows that the lower limit of the spot diameter (D) of a beam spot is proportional to the wavelength (λ) of the laser beam. ($N_A$ is the numerical aperture of a lens.)

$$D=1.22\lambda/N_A \quad (1)$$

Accordingly, in recent years, it is contemplated to use as an exposure light source a laser having a short oscillation wavelength (a blue semiconductor laser) (e.g., Japanese Patent Application Laid open No. H9 240051 (Patent Document 2)).

Where a laser having an oscillation wavelength within the range of from 380 nm to 450 nm is used as an exposure light source, the beam spot can be made to have a fairly small spot diameter (40 μm or less) in the state the sharpness of the contour of the beam spot is maintained. Hence, this enables achievement of ultra-high resolution, and is very advantageous for the achievement of ultra-high image quality.

Patent Document 1

Japanese Patent No. 3254833

Patent Document 2

Japanese Patent Application Laid open No. H9 240051

SUMMARY OF THE INVENTION

Problems the Invention Intends to Solve

In general, to both ends of a cylindrical electrophotographic photosensitive member, members for driving the electrophotographic photosensitive member rotatingly are fitted. The members (fitting members) to be fitted to the both ends of the electrophotographic photosensitive member may include gears as drive members and flanges as bearing members.

In an electrophotographic apparatus in which the beam spot has been made to have a small spot diameter (40 μm or less) by the use of the laser having an oscillation wavelength within the range of from 380 nm to 450 nm, a very high precision is required in regard to what is called an electrophotographic photosensitive member unit, in which the fitting members are fitted to both ends of the electrophotographic photosensitive member.

If the electrophotographic photosensitive member unit is made with poor precision, the amount of change in distance (imaging distance) between the electrophotographic photosensitive member and an exposure means may become large, and hence this may make it difficult to form beam spots accurately on the surface of the electrophotographic photosensitive member at the time of irradiation with laser beams, tending to cause roughness of images (coarseness or non-uniformity of halftone images).

In addition, if the electrophotographic photosensitive member unit is made with poor precision, at the time of development, the amount of change in a gap, or nip pressure, between the electrophotographic photosensitive member and a developing member (such as a developing roller or a developing sleeve) may become large, and this tends to cause roughness of images (coarseness or non-uniformity of halftone images) which comes from development unevenness, or, when color images are reproduced, color misregistration. Also, at the time of transfer, the positional precision between the electrophotographic photosensitive member and a transfer member or a transfer sheet may become insufficient, and this tends to cause color misregistration when color images are reproduced.

However, to solve such problems, any techniques taking note of the precision of electrophotographic photosensitive member units have not been available in the past. That is, even the electrophotographic apparatus in which the beam spot has been made to have a small spot diameter by the use of the laser having an oscillation wavelength within the range of from 380 nm to 450 nm has been insufficient for the achievement of image reproduction at ultra-high resolution and in ultra-high image quality.

An object of the present invention is to provide, in the electrophotographic apparatus in which the beam spot has been made to have a small spot diameter by the use of the laser having an oscillation wavelength within the range of from 380 nm to 450 nm, an electrophotographic photosensitive apparatus that has solved the above problems and enables image reproduction at ultra-high resolution and in ultra-high image quality, and also provide a process cartridge and an electrophotographic photosensitive member unit which are used in such an electrophotographic apparatus.

Means for Solving the Problems

As a result of extensive studies made in order to solve the above problems, the present inventors have discovered that, in the electrophotographic apparatus in which the beam spot has been made to have a small spot diameter by the use of the laser having an oscillation wavelength within the range of from 380 nm to 450 nm, as precision of an electrophotographic photosensitive member unit, its cylinder deflection is most deeply concerned in the above problems and tends to affect the image reproduction at ultra-high resolution and in ultra-high image quality.

The present inventors have also discovered that the image reproduction at ultra-high resolution and in ultra-high image quality is possible only when the cylinder deflection of the electrophotographic photosensitive member unit has a definite relationship to the spot diameter of the beam spot.

More specifically, the present invention is an electrophotographic apparatus which has I) an electrophotographic photosensitive member unit having i) an electrophotographic photosensitive member having a photosensitive layer on a cylindrical support and ii) fitting members fitted to the end portions of the electrophotographic photosensitive member and II) an exposure means having a laser having an oscillation wavelength within the range of from 380 nm to 450 nm, and in which a spot diameter Di (μm) of a beam spot formed on the surface of the electrophotographic photosensitive member by a laser beam emitted from the laser is 40 μm or less, wherein the cylinder deflection De (μm) of the electrophotographic photosensitive member unit is 1.5 times or less the spot diameter Di (μm) of the beam spot.

The present invention is also a process cartridge which has an electrophotographic photosensitive member unit having i) an electrophotographic photosensitive member having a photosensitive layer on a cylindrical support and ii) fitting members fitted to the end portions of the electrophotographic photosensitive member; and which is:

a process cartridge detachably mountable to an electrophotographic apparatus, which cartridge has an exposure means having a laser having an oscillation wavelength within the range of from 380 nm to 450 nm, and in which a spot diameter Di (μm) of a beam spot formed on the surface of the electrophotographic photosensitive member by a laser beam emitted from the laser is 40 μm or less, wherein the cylinder deflection De (μm) of the electrophotographic photosensitive member unit is 1.5 times or less the spot diameter Di (μm) of the beam spot.

The present invention is still also an electrophotographic photosensitive member unit which has i) an electrophotographic photosensitive member having a photosensitive layer on a cylindrical support and ii) fitting members fitted to the end portions of the electrophotographic photosensitive member; and which is:

an electrophotographic photosensitive member unit used in an electrophotographic apparatus which has an exposure means having a laser having an oscillation wavelength within the range of from 380 nm to 450 nm, and in which a spot diameter Di (μm) of a beam spot formed on the surface of the electrophotographic photosensitive member by a laser beam emitted from the laser is 40 μm or less, wherein the cylinder deflection De (μm) of the electrophotographic photosensitive member unit is 1.5 times or less the spot diameter Di (μm) of the beam spot.

Effect of the Invention

The present invention can provide, in the electrophotographic apparatus in which the beam spot has been made to have a small spot diameter by the use of the laser having an oscillation wavelength within the range of from 380 nm to 450 nm, an electrophotographic photosensitive apparatus that enables image reproduction at ultra-high resolution and in ultra-high image quality, and also can provide a process cartridge and an electrophotographic photosensitive member unit which are used in such an electrophotographic apparatus.

DESCRIPTION OF THE PREFERRED EMBODIMENTS

The present invention is described below in greater detail.

First, how to measure the spot diameter Di (μm) of a beam spot in the present invention is described with reference to FIG. 1.

In the present invention, the spot diameter of a beam spot is expressed at the part extending until the intensity decreases to $A \times 1/e^2$ where A is the peak intensity. Incidentally, as to intensity distribution, it includes Gauss distribution and Lorentz distribution.

The spot diameter of a beam spot is also measured at nine points set by dividing an image formation region into eight regions in the lengthwise direction, and the average value of measurements at the nine points is regarded as the spot diameter Di (μm) of a beam spot.

Figure 1:
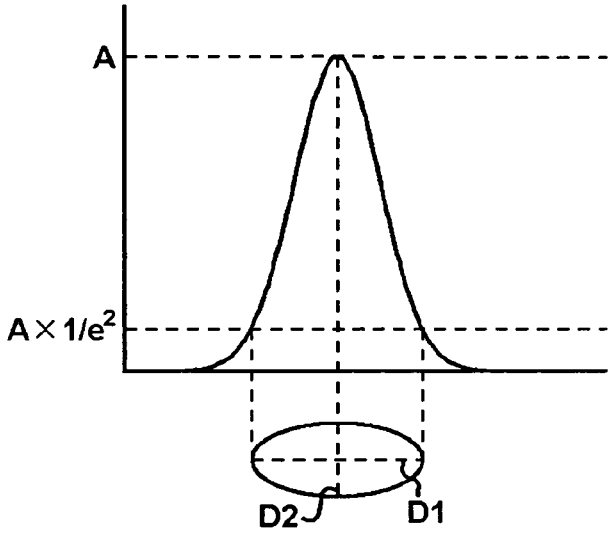
FIG. 1 is a graph for showing a method of measuring the spot diameter Di (μm) of the beam spot.

In general, the beam spot mostly has a shape which is oval as shown in FIG. 1. Accordingly, the spot diameter of a beam spot at each measurement point is expressed as an average value of the primary scanning direction (lengthwise direction) spot diameter D1 and the secondary scanning direction (circumferential direction) spot diameter D2.

In the present invention, the primary scanning direction spot diameter D1 and secondary scanning direction spot diameter D2 of the beam spot are also both measured with a beam analyzer manufactured by Melles Griot Co.

In the present invention, the spot diameter Di (μm) of a beam spot that is measured as described above must be 40 μm or less.

Figure 2:
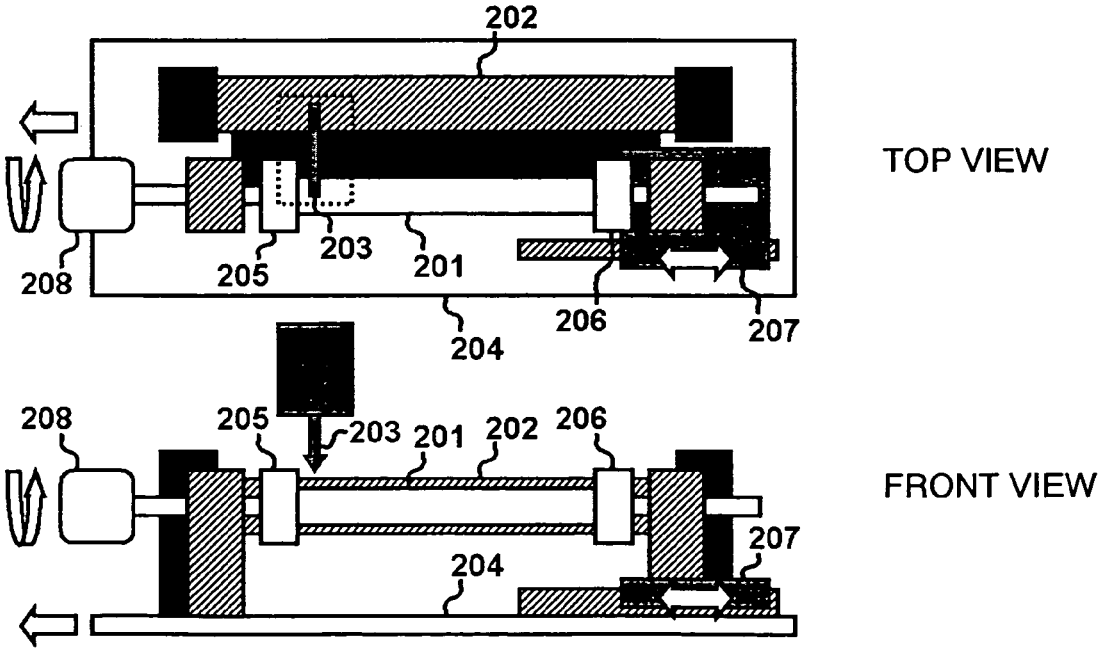
FIG. 2 is a schematic view showing the construction of a cylinder-deflection measuring instrument.

Next, how to measure the cylinder deflection De (μm) of the electrophotographic photosensitive member unit in the present invention is described with reference to FIG. 2. FIG. 2 is a schematic view showing the construction of a cylinder deflection measuring instrument.

As shown in FIG. 2, an electrophotographic photosensitive member unit 201 is secured with a drive-side bearer jig 205 and a follower-side bearer jig 206 by moving a slide base 207 in the directions of the arrows shown in FIG. 2. The distance between a standard gauge 202 manufactured with in an ultra-high precision and the electrophotographic photosensitive member unit 201 is measured by applying light 203 of a laser installed at the upper part of the electrophotographic photosensitive member unit.

The distance between the standard gauge 202 and the electrophotographic photosensitive member unit 201 is measured in its lengthwise direction by moving in the directions of the arrows shown in FIG. 2 a base 204 itself placed on a platen (not shown) via a linear guide (not shown). The distance between the standard gauge 202 and the electrophotographic photosensitive member unit 201 is also measured in its circumferential direction by rotating the electrophotographic photosensitive member unit 201 in the directions of the arrows shown in FIG. 2 by means of a rotating device 208. In either case of the lengthwise direction and the circumferential direction, the distance is measured in the state the laser is set to be stationary.

The cylinder deflection of the electrophotographic photosensitive member unit is also measured at nine points set by dividing an image formation region into eight regions in the lengthwise direction and at eight points set by dividing it into eight in the circumferential direction at intervals of 45 degrees, seventy-two points in total, and the difference between the maximum value and the minimum value at the seventy-two points is regarded as the cylinder deflection De (μm). This value is calculated with a data processing unit (not shown).

Incidentally, the drive-side bearer jig 205 and the follower-side bearer jig 206 may each have a shape that conforms to fitting members (e.g., gears as drive members and flanges as bearing members) to be fitted to the both ends of the electrophotographic photosensitive member.

As long as the cylinder deflection De (μm) of the electrophotographic photosensitive member unit measured as described above is 1.5 times or less the spot diameter Di (μm) of the beam spot ($De/Di \leqq 1.5$), the amount of change in distance (imaging distance) between the electrophotographic photosensitive member and an exposure means can be small, and hence this makes it possible to form beam spots accurately on the surface of the electrophotographic photosensitive member at the time of irradiation with laser beams.

In addition, at the time of development, the amount of change in a gap, or the nip pressure, between the electrophotographic photosensitive member and a developing member (such as a developing roller or a developing sleeve) can be small, and hence this can no longer cause roughness of images (coarseness or non-uniformity of halftone images) which comes from development unevenness, or, when color images are reproduced, color misregistration. Also, at the time of transfer, the positional precision between the electrophotographic photosensitive member and a transfer member or a transfer sheet can be sufficient, and hence this can no longer cause color misregistration when color images are reproduced.

Thus, images can be reproduced at ultra-high resolution and in ultra-high image quality.

The cylinder deflection De (μm) of the electrophotographic photosensitive member unit may also preferably be 1.0 times or less the spot diameter Di (μm) of the beam spot ($De/Di \leqq 1.0$), and more preferably 0.5 times or less ($De/Di \leqq 0.5$).

As a method for making small the cylinder deflection De (μm) of the electrophotographic photosensitive member unit, a method is available in which the precision of the electrophotographic photosensitive member is improved, e.g., the cylinder deflection of the electrophotographic photosensitive member is made small. A method is also available in which the precision of portions where the electrophotographic photosensitive member and the fitting members unite with one another and the precision of the fitting members with respect to the drive shaft are improved.

As a method for improving the precision of the electrophotographic photosensitive member, a method is available in which the precision of the cylindrical support of the electrophotographic photosensitive member is improved, e.g., the cylinder deflection of the cylindrical support of the electrophotographic photosensitive member is made small. Stated specifically, a method is available in which the cylindrical support is made to have a large wall thickness, the interior of the cylindrical support is cut at its both ends, or the cylindrical support is cut at its surface.

As a method for improving the precision of portions where the electrophotographic photosensitive member and the fitting members unite with one another, a method is available in which the interior of the cylindrical support is cut at its both ends, the tolerance of portions with which the fitting members unite is made narrow, or fitting members (flanges) are used which have been worked by cutting with a cutting tool in inner and outer diameters simultaneously.

As a method for improving the precision of the fitting members with respect to the drive shaft, a method is available in which the fitting members and the drive shaft are improved in concentricity.

Incidentally, the cylinder deflection of the electrophotographic photosensitive member and the cylinder deflection of the cylindrical support may be measured according to the method for measuring the cylinder deflection of the electrophotographic photosensitive member unit as described above, using in place of the electrophotographic photosensitive member unit 201, the electrophotographic photosensitive member and the cylindrical support as measurement objects. In that case, the drive-side bearer jig 205 and the follower-side bearer jig 206 may have shapes that conform to both ends of the electrophotographic photosensitive member and both ends of the cylindrical support, respectively.

The electrophotographic photosensitive member used in the present invention is constructed as described below.

As mentioned above, the electrophotographic photosensitive member used in the present invention is an electrophotographic photosensitive member having a photosensitive layer on a cylindrical support. In the following, the cylindrical support is simply termed the support.

The photosensitive layer may be either of a single-layer type photosensitive layer (FIG. 3A) which contains a charge-transporting material and a charge-generating material in the same layer and a multi-layer type (function-separated type) photosensitive layer which is separated into a charge generation layer containing a charge-generating material and a charge transport layer containing a charge-transporting material. From the viewpoint of electrophotographic performance, the multi-layer type photosensitive layer is preferred. The multi-layer type photosensitive layer may also include a regular-layer type photosensitive layer (FIG. 3B) in which the charge generation layer and the charge transport layer are superposed in this order from the support side and a reverse-layer type photosensitive layer (FIG. 3C) in which the charge transport layer and the charge generation layer are superposed in this order from the support side. From the viewpoint of electrophotographic performance, the regular-layer type photosensitive layer is preferred.

Figure 3A:
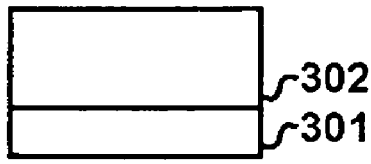
FIGS. 3A, 3B and 3C are schematic views showing the construction of photosensitive layers.
Figure 3B:
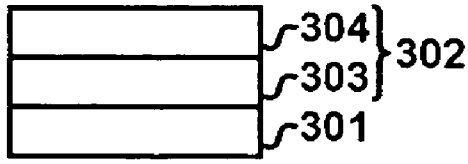
Figure 3C:
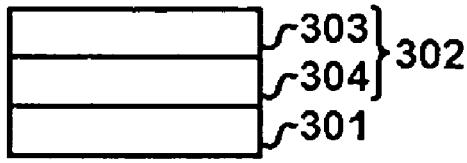

Incidentally, in FIGS. 3A, 3B and 3C, reference numeral 301 denotes the support; 302 denotes, the photosensitive layer; 303 denotes the charge generation layer; and 304 denotes the charge transport layer.

As the support, it may be one having conductivity. For example, usable are supports made of a metal (alloy) such as aluminum, aluminum alloy, copper, zinc, stainless steel, vanadium, molybdenum, chromium, titanium, nickel, indium, gold and platinum. Also usable are the above supports made of a metal (alloy), or supports made of a plastic (such as polyethylene, polypropylene, polyvinyl chloride, polyethylene terephthalate or acrylic resin), and having layers film-formed by vacuum deposition of any of these metals. Still also usable are the above supports made of a metal, or supports made of a plastic, and coated with conductive fine particles such as carbon black or silver particles together with a suitable binder resin; supports impregnated with the above conductive fine particles together with a suitable binder resin; and plastics containing a conductive binder resin.

As the support, preferred is the one having a small cylinder deflection of the support itself as described above, in order to restrain the cylinder deflection of the electrophotographic photosensitive member unit.

On the support, a conductive layer intended for the prevention of interference fringes caused by scattering of laser light or the like or for the covering of scratches of the support may be provided. The conductive layer may be formed by coating the support with a dispersion prepared by dispersing conductive particles, such as metal particles, or metal oxide particles in a binder resin. The conductive layer may preferably have a layer thickness of 1 μm or more, more preferably 5 μm or more, and still more preferably 10 μm or more, and on the other hand, preferably 40 μm or less, and more preferably 30 μm or less.

An intermediate layer functioning as a barrier and performing adhesion may also be provided between the support or the conductive layer and the photosensitive layer (charge generation layer or charge transport layer). The intermediate layer is formed for the purposes of, e.g., improving the adhesion of the photosensitive layer, improving coating performance, improving the injection of electric charges from the support and protecting the photosensitive layer from any electrical breakdown. The intermediate layer may be formed using a material such as polyvinyl alcohol, polyethylene oxide, ethyl cellulose, methyl cellulose, casein, polyamide, glue or gelatin. The intermediate layer may preferably have a layer thickness of 0.05 μm to 5 μm, and particularly more preferably from 0.2 μm to 3.0 μm.

The charge-generating material used in the electrophotographic photosensitive member used in the present invention may preferably be one having absorption within the range of wavelengths from 380 nm to 450 nm and having the sensitivity necessary for obtaining full-color images with ultra-high resolution and ultra-high image quality. It is preferable to use phthalocyanine pigments such as metal phthalocyanines and metal-free phthalocyanine, azo pigments such as monoazo, disazo and trisazo, any of which may be used alone or in the form of a mixture of two or more. Also usable are cationic dyes such as pyrylium dyes, thiapyrylium dyes, azulenium dyes, thiacyanine dyes and quinocyanine dyes, squalium salt dyes, polycyclic quinone pigments such as anthanthrone pigments, dibenzopyrenequinone pigments and pyranthrone pigments, indigo pigments, quinacridone pigments, and perylene pigments.

In the case when the photosensitive layer is the multi-layer type photosensitive layer, the binder resin used to form the charge generation layer may include, e.g., polyvinyl butyral, polyvinyl benzal, polyarylates, polycarbonates, polyesters, phenoxy resins, cellulose resins, acrylic resins, and polyurethanes. These resins may have a substituent. As the substituent, preferred are a halogen atom, an alkyl group, an alkoxyl group, a nitro group, a cyano group, a trifluoromethyl group and so forth. One or two or more of any of these may be used alone or in the form of a mixture or copolymer. The binder resin may also preferably be used in an amount of 80% by weight or less, and more preferably 60% by weight or less, based on the total weight of the charge generation layer.

The charge generation layer may be formed by coating a charge-generation-layer coating dispersion obtained by dispersing the charge-generating material together with the binder resin and a solvent, followed by drying. As a method for dispersion, a method is available which makes use of a homogenizer, ultrasonic waves, a ball mill, a sand mill, an attritor, a roll mill or the like. The charge-generating material and the binder resin may preferably be in a proportion ranging from 1:0.1 to 1:4 (weight ratio), and particularly more preferably ranging from 1:0.3 to 1:4 (weight ratio).

The solvent used for the charge-generation-layer coating dispersion, it may be selected taking account of the binder resin to be used and the solubility or dispersion stability of the charge generating material. It may include, e.g., ethers such as tetrahydrofuran, 1,4-dioxane and 1,2-dimethoxyethane, ketones such as cyclohexanone, methyl ethyl ketone and pentanone, amines such as N,N dimethylformamdie, esters such as methyl acetate and ethyl acetate, aromatics such as toluene, xylene and chlorobenzene, alcohols such as methanol, ethanol and 2-propanol, and aliphatic halogenated hydrocarbons such as chloroform, methylene chloride, dichloroethylene, carbon tetrachloride and trichloroethylene.

When the charge-generation-layer coating solution is coated, coating methods as exemplified by dip coating, spray coating, spinner coating, roller coating, Mayer bar coating, and blade coating may be used.

The charge generation layer may preferably have a layer thickness of 5 μm or less, and particularly more preferably from 0.1 μm to 2 μm.

To the charge generation layer, a sensitizer, an antioxidant, an ultraviolet absorber, a plasticizer, a thickening agent and so forth which may be of various types may also optionally be added.

The charge-transporting material used in the electrophotographic photosensitive member used in the present invention may include, e.g., charge-transporting materials such as electron-attracting substances such as 2,4,7-trinitrofluorenone, 2,4,5,7-tetranitrofluorenone, chloranil and tetracyanoquinodimethane, and those obtained by polymerizing these electron-attracting substances; or hole-transporting materials such as polycyclic aromatic compounds such as pyrene and anthracene, heterocyclic compounds such as carbazole compounds, indole compounds, oxazole compounds, thiazole compounds, oxadiazole compounds, pyrazole compounds, pyrazoline compounds, thiadiazole compounds and triazole compounds, hydrazone compounds, styryl compounds, benzidine compounds, triarylmethane compounds, and triphenylamine compounds. Any of these may be used alone or in the form of a mixture of two or more.

In the case when the photosensitive layer is the multilayer type photosensitive layer, the binder resin used to form the charge transport layer may include, e.g., acrylic resins, polyarylates, polycarbonates, polyesters, polystyrene, an acrylonitrile-styrene copolymer, polyacrylamide, and polyamide. One or two or more of any of these may be used alone or in the form of a mixture or copolymer.

A photoconductive resin may also be used which functions as both the charge-transporting material and the binder resin, such as a polymer (e.g., poly-N-vinyl carbazole, polyvinyl anthracene) having in the backbone chain or side chain a group derived from the above charge-transporting material.

The charge transport layer may be formed by coating a charge-transport-layer coating solution obtained by dissolving the charge-transporting material and binder resin in a solvent, followed by drying. The charge-transporting material and the binder resin may preferably be in a proportion ranging from 2:1 to 1:2 (weight ratio).

As the solvent used in the charge-transport-layer coating solution, usable are ethers such as tetrahydrofuran and dimethoxymethane, ketones such as acetone and methyl ethyl ketone, esters such as methyl acetate and ethyl acetate, aromatic hydrocarbons such as toluene and xylene, and hydrocarbons substituted with a halogen atom, such as chlorobenzene, chloroform and carbon tetrachloride.

When the charge-transport-layer coating solution is coated, coating methods as exemplified by dip coating, spray coating, spinner coating, roller coating, Mayer bar coating and blade coating may be used.

The charge transport layer may preferably have a layer thickness of from 5 μm to 40 μm, particularly more preferably from 5 μm to 30 μm, and still more preferably from 5 μm to 20 μm.

To the charge transport layer, an antioxidant, an ultraviolet absorber, a plasticizer, a filler and so forth may also optionally be added.

In the case when the photosensitive layer is of the regular-layer type, it is preferable to select a charge-transporting material and a binder resin which have a high transmittance to the wavelength of the laser beam to be used.

In the case when the photosensitive layer is of the single-layer type, the single-layer type photosensitive layer may be formed by coating a single-layer type photosensitive layer coating dispersion obtained by dispersing the charge-generating material and the charge-transporting material together with the binder resin and the solvent, followed by drying.

A protective layer may also be provided on the photosensitive layer, for the purpose of protecting the photosensitive layer from mechanical force, chemical force and so forth and also for the purpose of improving transfer performance and cleaning performance.

The protective layer may be formed by coating a protective-layer coating solution obtained by dissolving a resin such as polyvinyl butyral, polyester, polycarbonate, polyamide, polyimide, polyarylate, polyurethane, a styrene-butadiene copolymer, a styrene-acrylic acid copolymer or a styrene-acrylonitrile copolymer in an organic solvent, followed by drying.

In order to make the protective layer have charge transport performance together, the protective layer may also be formed by curing a monomer material having charge transport performance, or a polymer type charge-transporting material, by cross-linking reaction. The reaction by which it is cured may include radical polymerization, ion polymerization, thermal polymerization, photopolymerization, radiation polymerization (electron ray polymerization), plasma assisted CVD and photo assisted CVD.

The protective layer may further be incorporated with conductive particles, an ultraviolet absorbent, a wear resistance improver and so forth. As the conductive particles, metal oxides as exemplified by tin oxide particles are preferred. As the wear resistance improver, fine fluorine resin powders, alumina, silica and the like are preferred.

To the protective layer, conductive particles, an ultraviolet absorbent, a wear resistance improver and so forth may further be added. As the conductive particles, metal oxides such as tin oxide particles are preferred. As the wear resistance improver, fine fluorine atom containing resin particles, alumina, silica and the like are preferred.

The protective layer may preferably have a layer thickness of from 0.5 μm to 20 μm, and particularly preferably from 1 μm to 10 μm.

In the present invention, the surface layer refers to the single-layer type photosensitive layer in the case of the layer construction as shown in FIG. 3A (single-layer type), refers to the charge transport layer in the case of the layer construction as shown in FIG. 3B (regular-layer type), and refers to the charge generation layer in the case of the layer construction as shown in FIG. 3C (reverse-layer type). Also, where the protective layer is provided on any of these, the protective layer serves as the surface layer of the electrophotographic photosensitive member.

A developer used in the present invention is described below.

The developer is roughly grouped into a two-component developer consisting of a toner and a carrier and a one-component developer consisting of only a toner. It may also be grouped into a magnetic developer and a non-magnetic developer according to whether or not it has magnetic properties.

The toner contained in the developer used in the present invention may preferably have a specific particle size distribution. More specifically, if less than 17% of the total number of toner particles have a particle diameter of 5 μm or less, the toner may be consumed in a large quantity. In addition, if the toner has a volume-average particle diameter Dv (μm) of 8 μm or more and a weight-average particle diameter D4 (μm) of 9 μm or more, the resolution of dots of 100 μm or less in diameter tends to decrease, and this tendency is more remarkable in regard to the resolution of dots of 20 to 40 μm. In such a case, even if it is attempted to perform development according to unnatural designing under different development conditions, it is difficult to achieve stable developing performance, such that thick-line images or toner scatter tends to occur or the toner may be consumed in a large quantity. If on the other hand, more than 90% of the total number of toner particles have a particle diameter of 5 μm or less, it may be difficult to achieve stable developing performance to cause the difficulty such that the image density decreases. In order to more improve resolution, the toner may preferably satisfy the inequalities 3.0 μm≦Dv≦6.0 μm and 3.5 μm≦D4≦6.5 μm, and particularly more preferably 3.2 μm≦Dv≦5.8 μm and 3.6 μm≦D4≦6.3 mμ.

A binder resin used in the toner, it may include, e.g., styrene homopolymers or styrene copolymers such as polystyrene, a styrene-acrylate copolymer, a styrene-methacrylate copolymer and a styrene-butadiene copolymer, polyester resins, epoxy resins, and petroleum resins.

In view of the improvement in releasability from a fixing member and the improvement in fixing performance at the time of fixing, it is preferable to incorporate a wax in the toner. The wax may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives include oxides, block copolymers with vinyl monomers, and graft modified products. Besides, also usable are long-chain alcohols, long-chain fatty acids, acid amide compounds, ester compounds, ketone compounds, hardened caster oil and derivatives thereof, vegetable waxes, animal waxes, mineral waxes and petrolatums.

As a colorant used in the toner, an inorganic pigment, an organic dye and an organic pigment, which are of various types, may be used, including, e.g., carbon black, Aniline Black, acetylene black, Naphthol Yellow, Hanza Yellow, Rhodamine Lake, Alizarine Lake, red iron oxide, Phthalocyanine Blue and Indanethrene Blue. The colorant and the binder resin may preferably be in a proportion ranging from 0.5:100 to 20:100 (in weight ratio).

The toner may also be incorporated with a magnetic material. The magnetic material may include magnetic metal oxides containing an element such as iron, cobalt, nickel, copper, magnesium, manganese, aluminum or silicon. Of these, those composed chiefly of a magnetic iron oxide such as triion tetraoxide and γ-iron oxide are preferred.

For the purpose of charge control of the toner, the toner may also be incorporated with a Nigrosine dye, a quaternary ammonium salt, a salicylic acid metal complex, a salicylic acid metal salt, a salicylic acid derivative metal complex, salicylic acid, or acetylacetone.

The toner may also be so made up so that an inorganic fine powder has externally been added to toner particles. The external addition of the inorganic fine powder to toner particles brings an improvement in development efficiency, reproducibility of electrostatic latent images, and transfer efficiency, and makes fog occur less. The inorganic fine powder may include, e.g., fine powders of colloidal silica, titanium oxide, iron oxide, aluminum oxide, magnesium oxide, calcium titanate, barium titanate, strontium titanate, magnesium titanate, cerium oxide, zirconium oxide and so forth. One or two or more of any of these may be used alone or in the form of a mixture. Of these, fine powders of oxides such as titania, alumina and silica or double oxides are preferred.

The inorganic fine powder added externally to toner particles may also preferably be one having been subjected to hydrophobic treatment. In particular, it may preferably be one having been subjected to surface treatment with a silane coupling agent or a silicone oil. As methods for such hydrophobic treatment, available are a method in which the inorganic fine powder is treated with an organic metal compound, such as a silane coupling agent or a titanium coupling agent, capable of reacting with the inorganic fine powder or physically adsorptive to the inorganic fine powder, and a method in which the inorganic fine powder is treated with an organosilicon compound, such as silicone oil, after it has been treated with a silane coupling agent or while it is treated with a silane coupling agent. The inorganic fine powder having been subjected to the hydrophobic treatment may preferably be used in an amount of from 0.01 to 8% by weight, particularly more preferably from 0.1 to 5% by weight, and still more preferably from 0.2 to 3% by weight.

The inorganic fine powder added externally to toner particles may also preferably have a BET specific surface area of 30 $m^2/g$ or more, and particularly within the range of from 50 to 400 $m^2/g$, according to nitrogen adsorption as measured by the BET method.

To the toner, other additives may further be added so long as they substantially do not adversely affect the toner. They may include, e.g., lubricant powders such as polytetrafluoroethylene powder, zinc stearate powder and polyvinylidene fluoride powder; abrasives such as cerium oxide powder, silicon carbide powder and strontium titanate powder; fluidity-providing agents such as titanium oxide powder and aluminum oxide powder; anti-caking agents; conductivity-providing agents such as carbon black powder, zinc oxide powder and tin oxide powder; and developing performance imporvers, such as organic particles and inorganic particles, with a polarity opposite to that of the toner.

To produce the toner, known methods may be used. For example, the binder resin, the wax, the metal salt or metal complex, the colorant, and optionally the magnetic material, the charge control agent and other additives are thoroughly mixed by means of a mixing machine such as a Henschel mixer or a ball mill, and then the mixture obtained is melt-kneaded by means of a heat kneading machine such as a heat roll, a kneader or an extruder to make the resin and so forth melt one another, in which the metal salt or metal complex, the pigment, the magnetic material and so forth are made to disperse or dissolve, followed by cooling for solidification and thereafter pulverization and strict classification. Thus, the toner can be obtained. In the step of classification, a multi-division classifier may preferably be used in view of production efficiency.

The toner may also be produced by a method in which a polymerizable monomer, the colorant and so forth are suspended in an aqueous medium and polymerization is carried out to produce toner particles directly, or a method in which fine polymer particles obtained by emulsion polymerization or the like are dispersed in an aqueous medium to make them undergo association and fusing together with the colorant.

In the case of the two-component developer, the carrier having magnetic properties may include, e.g., powders of magnetic ferrite, magnetite, iron and the like, and those obtained by coating these with a resin such as an acrylic resin, a silicone resin or a fluorine resin.

The developing system of the electrophotographic apparatus of the present invention, may preferably be a contact developing system, such as magnetic brush developing system, making use of the two-component developer, in which the developer and the surface of the electrophotographic photosensitive member come into contact, and also preferably a reverse developing system.

Figure 4:
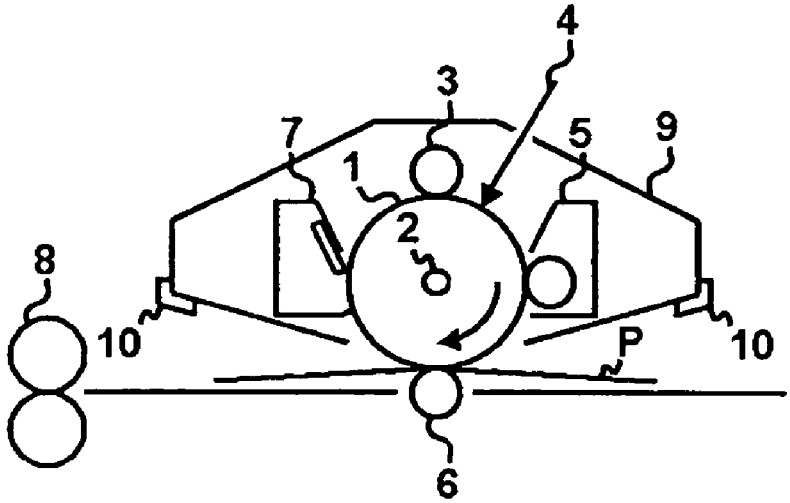
FIG. 4 is a schematic view showing an example of the construction of an electrophotographic apparatus having a process cartridge.

FIG. 4 schematically illustrates the construction of an electrophotographic apparatus having a process cartridge.

In FIG. 4, reference numeral 1 denotes a cylindrical electrophotographic photosensitive member, which is rotatingly driven around an axis 2 in the direction of an arrow at a stated peripheral speed. Fitting members (drive members and/or bearing members) are also fitted (not shown) to the both ends of the electrophotographic photosensitive member 1 in order to drive the electrophotographic photosensitive member 1 rotatingly, and the electrophotographic photosensitive member 1 and the fitting members constitute an electrophotographic photosensitive member unit.

The surface of the electrophotographic photosensitive member 1, rotatingly driven, is uniformly electrostatically charged to a positive or negative, given potential through a charging means (primary charging means) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer in a developing means 5, to form toner images (developed images; the same applies hereinafter). Then, the toner images thus formed and held on the surface of the electrophotographic photosensitive member 1 and are successively transferred by applying a transfer bias from a transfer means (transfer roller) 6, which are transferred onto to a transfer material (such as paper) P fed from a transfer-material feed means (not shown) to the part (contact zone) between the electrophotographic photosensitive member 1 and the transfer means 6 in a manner synchronized with the rotation of the electrophotographic photosensitive member 1.

The transfer material P to which the toner images have been transferred is separated from the surface of the electrophotographic photosensitive member 1, is led through a fixing means 8, where the toner images are fixed, and is then put out of the apparatus as an image formed material (a print or copy).

The surface of the electrophotographic photosensitive member 1 from which the toner images have been transferred has the developer (toner) remaining after the transfer removed therefrom, through a cleaning means (cleaning blade) 7. Thus, its surface is cleaned. It is further subjected to charge elimination by pre-exposure light (not shown) emitted from a pre-exposure means (not shown), and thereafter repeatedly used for the formation of images. Incidentally, where as shown in FIG. 4 the primary charging means 3 is a contact charging means making use of a charging roller or the like, the pre-exposure is not necessarily required.

The apparatus may be constituted of a combination of plural components integrally joined in a container as a process cartridge from among the constituents such as the above electrophotographic photosensitive member unit, the charging means 3, the developing means 5, the transfer means 6 and the cleaning means 7 so that the process cartridge is set detachably mountable to the main body of an electrophotographic apparatus, such as a copying machine or a laser beam printer. In the apparatus shown in FIG. 4, the electrophotographic photosensitive member unit and the charging means 3, the developing means 5 and the cleaning means 7 are integrally supported to form a process cartridge 9 that is detachably mountable to the main body of the apparatus through a guide means 10, such as rails, provided in the main body of the apparatus.

Now, as it occurs where the electrophotographic photosensitive member unit is made with a poor precision, the amount of change in distance (imaging distance) between the electrophotographic photosensitive member and the exposure means may become large, and hence this may make it difficult to form beam spots accurately on the surface of the electrophotographic photosensitive member at the time of irradiation with laser beams. Also, at the time of development, the amount of change in a gap, or nip pressure, between the electrophotographic photosensitive member and the developing member (such as a developing roller or a developing sleeve) may become large, and hence this tends to cause roughness of images (coarseness or non-uniformity of halftone images) which comes from development unevenness. Such technical problems are technical problems which are general to electrophotographic apparatus. Especially in the case of color electrophotographic apparatus, if the electrophotographic photosensitive member unit is made with poor precision, the amount of change in a gap, or nip pressure, between the electrophotographic photosensitive member and the developing member (such as a developing roller or a developing sleeve) may become large, and hence this tends to cause color misregistration due to development non-uniformity. Also, at the time of transfer, the positional precision between the electrophotographic photosensitive member and the transfer member or the transfer sheet may become insufficient, and hence this tends to cause color misregistration. Such technical problems peculiar to color image formation may further arise. Accordingly, the present invention exhibits its effect more remarkably when the electrophotographic apparatus is a color electrophotographic apparatus.

As examples of such a color electrophotographic apparatus, a color electrophotographic apparatus of an intermediate-transfer system, a color electrophotographic apparatus of an in line-system and a color electrophotographic apparatus of a multiple-transfer system are described below. Incidentally, examples of four color (yellow, magenta, cyan and black) image formation are given in the following description. The "color" referred to in the present invention, however, is by no means limited to the four colors (what is called full-color), and refers to multi-color, i.e., two or more colors.

Figure 5:
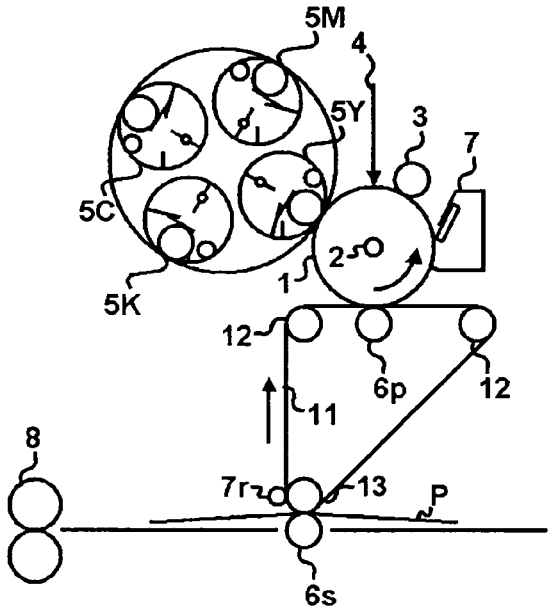
FIG. 5 is a schematic view showing an example of the construction of a color electrophotographic apparatus of an intermediate-transfer system.

FIG. 5 schematically illustrates the construction of the color electrophotographic apparatus of an intermediate transfer system. In the case of the intermediate transfer system, its transfer means is chiefly constituted of a primary transfer member, an intermediate transfer member and a secondary transfer member.

In FIG. 5, reference numeral 1 denotes a cylindrical electrophotographic photosensitive member, which is rotatingly driven around an axis 2 in the direction of an arrow at a stated peripheral speed. Fitting members (drive members and/or bearing members) are also fitted (not shown) to the both ends of the electrophotographic photosensitive member 1 in order to drive the electrophotographic photosensitive member 1 rotatingly, and the electrophotographic photosensitive member 1 and the fitting members constitute an electrophotographic photosensitive member unit.

The surface of the electrophotographic photosensitive member 1 rotatingly driven is uniformly electrostatically charged to a positive or negative, given potential through a charging means (primary charging means) 3. The electrophotographic photosensitive member thus charged is then exposed to exposure light (imagewise exposure light) 4 emitted from an exposure means (not shown) for slit exposure, laser beam scanning exposure or the like. Here, the exposure light is exposure light corresponding to a first-color component image (e.g., a yellow component image) of an intended color image. In this way, first-color component electrostatic latent images (yellow component electrostatic latent images) corresponding to the first-color component image of the intended color image are successively formed on the surface of the electrophotographic photosensitive member 1.

An intermediate transfer member (intermediate transfer belt) 11 stretched by and over stretch rollers 12 and a secondary transfer opposing roller 13 is rotatingly driven in the direction of an arrow shown in FIG. 5 at substantially the same peripheral speed as the electrophotographic photosensitive member 1 (e.g., 97% to 103% with respect to the peripheral speed of the electrophotographic photosensitive member 1).

The first-color component electrostatic latent images thus formed on the surface of the electrophotographic photosensitive member 1 are developed with a first color toner (yellow toner) contained in a developer of a developing means 5Y (yellow component developing means), to form first-color toner images (yellow toner images). Then, the first-color toner images thus formed and held on the surface of the electrophotographic photosensitive member 1 are successively primarily transferred by applying a transfer bias from a primary transfer means 6*p*, which are transferred onto the surface of the intermediate transfer member 11 which passes the part between the electrophotographic photosensitive member 1 and the primary transfer means (primary transfer roller) 6*p*.

The surface of the electrophotographic photosensitive member 1 from which the first-color toner images have been transferred is cleaned by cleaning means 7, which removes the developer (toner) remaining after the primary transfer. Thus, the surface is cleaned, and thereafter the electrophotographic photosensitive member 1 is used for the formation of a next-color image.

Second-color toner images (magenta toner images), third-color toner images (cyan toner images) and fourth-color toner images (black toner images) are also formed on the surface of the electrophotographic photosensitive member 1 in the same manner as the first-color toner images, and transferred to the surface of the intermediate transfer member 11 in order. In this way, synthesized toner images corresponding to the intended color image are formed on the surface of the intermediate transfer member 11. During the primary transfer of the first-color to fourth-color toner images, a secondary transfer member (secondary transfer roller) 6*s* and a charge-providing means (charge providing roller) 7*r* are kept apart from the surface of the intermediate transfer member 11.

The synthesized toner images formed on the surface of the intermediate transfer member 11 are successively secondarily transferred by applying a transfer bias from the secondary transfer means 6*s*, which are transferred onto a transfer material (such as paper) P fed from a transfer material feed means (not shown) to the part (contact zone) between the intermediate transfer member 11 at its part of the secondary transfer opposing roller 13 and the secondary transfer means 6*s* in the manner synchronized with the rotation of the intermediate transfer member 11.

The transfer material P to which the synthesized toner images have been transferred is separated from the surface of the intermediate transfer member 11, is led through a fixing means 8, where the toner images are fixed, and is then put out of the apparatus as a color-image-formed material (a print or copy).

The charge-providing means 7*r* is brought into contact with the surface of the intermediate transfer member 11 from which the synthesized toner images have been transferred. The charge-providing means 7*r* imparts electric charges having a polarity opposite to that at the time of primary transfer, to the developers (toners) remaining after the secondary transfer. The developers (toners) remaining after the secondary transfer to which the electric charges having a polarity opposite to that at the time of primary transfer have been imparted are electrostatically transferred to the surface of the electrophotographic photosensitive member 1 at the part of contact between the electrophotographic photosensitive member 1 and the intermediate transfer member 11 and in the vicinity thereof. In this way, the surface of the intermediate transfer member 11 from which the synthesized toner images have been transferred has removed therefrom the developers (toners) remaining after the secondary transfer. Thus, the surface is cleaned. The developers (toners) remaining after the secondary transfer, having been transferred to the surface of the electrophotographic photosensitive member 1, are removed through the cleaning means 7 together with the developers (toners) remaining after the primary transfer. The transfer of the developers (toners) remaining after the secondary transfer, to the electrophotographic photosensitive member 1 can be performed simultaneously with the primary transfer, and hence any lowering of throughput by no means occurs.

The surface of the electrophotographic photosensitive member 1 from which the developers (toners) remaining after the transfer have been removed by a cleaning means 7 may also be subjected to charge elimination by pre-exposure light emitted from a pre-exposure means. Where as shown in FIG. 5 the charging means 3 is a contact charging means making use of a charging roller or the like, the pre-exposure is not necessarily required.

Figure 6:
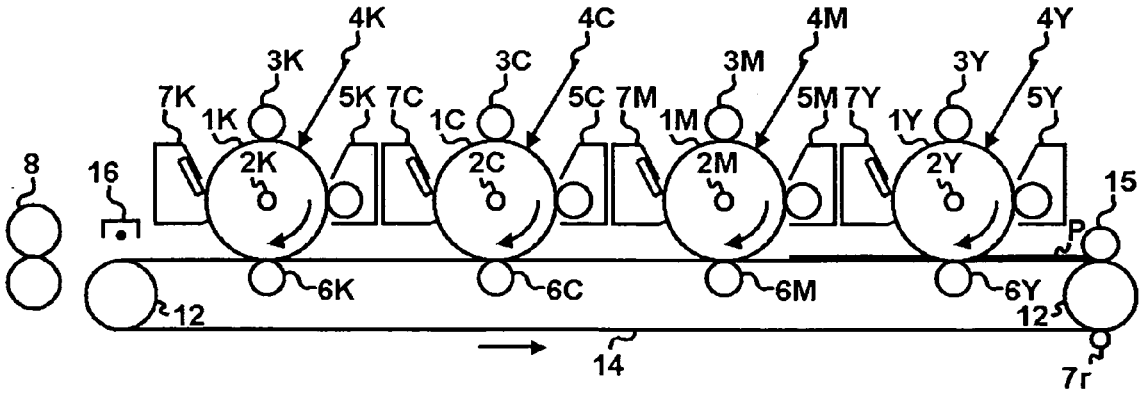
FIG. 6 is a schematic view showing an example of the construction of a color electrophotographic apparatus of an in-line system.

FIG. 6 schematically illustrates an example of the construction of the color electrophotographic apparatus of an in-line system. In the case of the in-line system, its transfer means is chiefly constituted of a transfer material transport member and a transfer member.

In FIG. 6, reference numerals 1Y, 1M, 1C and 1K denote cylindrical electrophotographic photosensitive members (electrophotographic photosensitive members for first color to fourth color), which are rotatingly driven around axes 2Y, 2M, 2C and 2K, respectively, in the directions of arrows shown in FIG. 6 at a stated peripheral speed each. Fitting members (drive members and/or bearing members) are also fitted (not shown) to the both ends of each of the electrophotographic photosensitive members 1Y, 1M, 1C and 1K in order to rotatingly drive the electrophotographic photosensitive members 1Y, 1M, 1C and 1K, respectively. The electrophotographic photosensitive member 1Y and its fitting members constitute an electrophotographic photosensitive member unit for the first color, the electrophotographic photosensitive member 1M and its fitting members constitute an electrophotographic photosensitive member unit for the second color, the electrophotographic photosensitive member 1C and its fitting members constitute an electrophotographic photosensitive member unit for the third color, and the electrophotographic photosensitive member 1K and its fitting members constitute an electrophotographic photosensitive member unit for the fourth color.

The surface of the electrophotographic photosensitive member 1Y rotatingly driven is uniformly electrostatically charged to a positive or negative, given potential through a charging means 3Y for the first color (primary charging means for first color). The electrophotographic photosensitive member thus charged is then exposed to exposure light (imagewise exposure light) 4Y emitted from an exposure means (not shown) for slit exposure, laser beam scanning exposure or the like. Here, the exposure light 4Y is exposure light corresponding to a first-color component image (e.g., a yellow component image) of an intended color image. In this way, first-color component electrostatic latent images (yellow component electrostatic latent images) corresponding to the first-color component image of the intended color image are successively formed on the surface of the electrophotographic photosensitive member 1Y. Similarly, charged members 1M, 1C, and 1K are exposed to exposure light 4M, 4C, and 4K, respectively, where exposure light 4M, 4C, and 4K correspond to the second-component image, the third-component image and the fourth-component image.

A transfer material transport member (transfer material transport belt) 14 stretched by and over stretch rollers 12 are rotatingly driven in the direction of an arrow shown in FIG. 6 at substantially the same peripheral speed as the electrophotographic photosensitive members 1Y, 1M, 1C and 1K for first color to fourth color (e.g., 97% to 103% with respect to the peripheral speed of each of the electrophotographic photosensitive members 1Y, 1M, 1C and 1K for the first color to the fourth color). Also, a transfer material (such as paper) P fed from a transfer material feed means (not shown) is electrostatically held on (attracted to) the transfer material transport member 14, and is successively transported to the parts (contact zones) between the electrophotographic photosensitive members 1Y, 1M, 1C and 1K for first color to fourth color and the transfer material transport member.

The first-color component electrostatic latent images thus formed on the surface of the electrophotographic photosensitive member 1Y for the first color are developed with a first-color toner contained in a developer of a developing means 5Y, to form first-color toner images (yellow toner images). Then, the first-color toner images thus formed and held on the surface of the electrophotographic photosensitive member 1Y for the first color are successively transferred by applying a transfer bias from a transfer member 6Y for the first color (transfer roller for the first color), which are transferred onto a transfer material P held on the transfer material transport member 14 which passes the part between the electrophotographic photosensitive member 1Y for the first color and the transfer member 6Y for the first color.

The surface of the electrophotographic photosensitive member 1Y for the first color from which the first-color toner images have been transferred has removed therefrom the developer (toner) remaining after the transfer, through a cleaning means 7Y for the first color (cleaning blade for the first color). Thus, the surface is cleaned, and thereafter the electrophotographic photosensitive member 1Y for the first color is repeatedly used for the formation of the first-color toner images.

The electrophotographic photosensitive member 1Y for the first color, the charging means 3Y for the first color, the exposure means for the first color, the developing means 5Y for the first color and the transfer member 6Y for the first color are collectively called an image forming section the for first color.

An image forming section for the second color which has an electrophotographic photosensitive member 1M for the second color, a charging means 3M for the second color, an exposure means for the second color, a developing means 5M for the second color and a transfer member 6M for the second color, an image forming section for the third color which has an electrophotographic photosensitive member 1C for the third color, a charging means 3C for the third color, an exposure means for the third color, a developing means 5C for the third color and a transfer member 6C for the third color, and an image forming section for the fourth color which has an electrophotographic photosensitive member 1K for the fourth color, a charging means 3K for the fourth color, an exposure means for the fourth color, a developing means 5K for the fourth color and a transfer member 6K for the fourth color are operated in the same way as the operation of the image forming section for the first color. Thus, second-color toner images (magenta toner images), third-color toner images (cyan toner images) and fourth-color toner images (black toner images) are transferred in order, to the transfer material P which is held on the transfer material transport member 14 and to which the first-color toner images have been transferred. In this way, synthesized toner images corresponding to the intended color image are formed on the surface of the transfer material P held on the transfer material transport member 14.

The transfer material P on which the synthesized toner images have been formed is separated from the surface of the transfer material transport member 14, is led through a fixing means 8, where the toner images are fixed, and is then put out of the apparatus as a color-image-formed material (a print or copy).

The surfaces of the electrophotographic photosensitive members 1Y, 1M, 1C and 1K for the first color to the fourth color from which the developers (toners) remaining after the transfer have been removed by cleaning means 7Y, 7M, 7C and 7K for the first color to the fourth color may also be subjected to charge elimination by pre-exposure light emitted from pre-exposure means. Where as shown in FIG. 5 the charging means 3Y, 3M, 3C and 3K for the first color to the fourth color are contact charging means making use of charging rollers or the like, the pre-exposure is not necessarily required.

Incidentally, in FIG. 6, reference numeral 15 denotes an attraction roller for attracting the transfer material to the transfer material transport member; and 16 denotes a separation charging assembly for separating the transfer material from the transfer material transport member.

Figure 7:
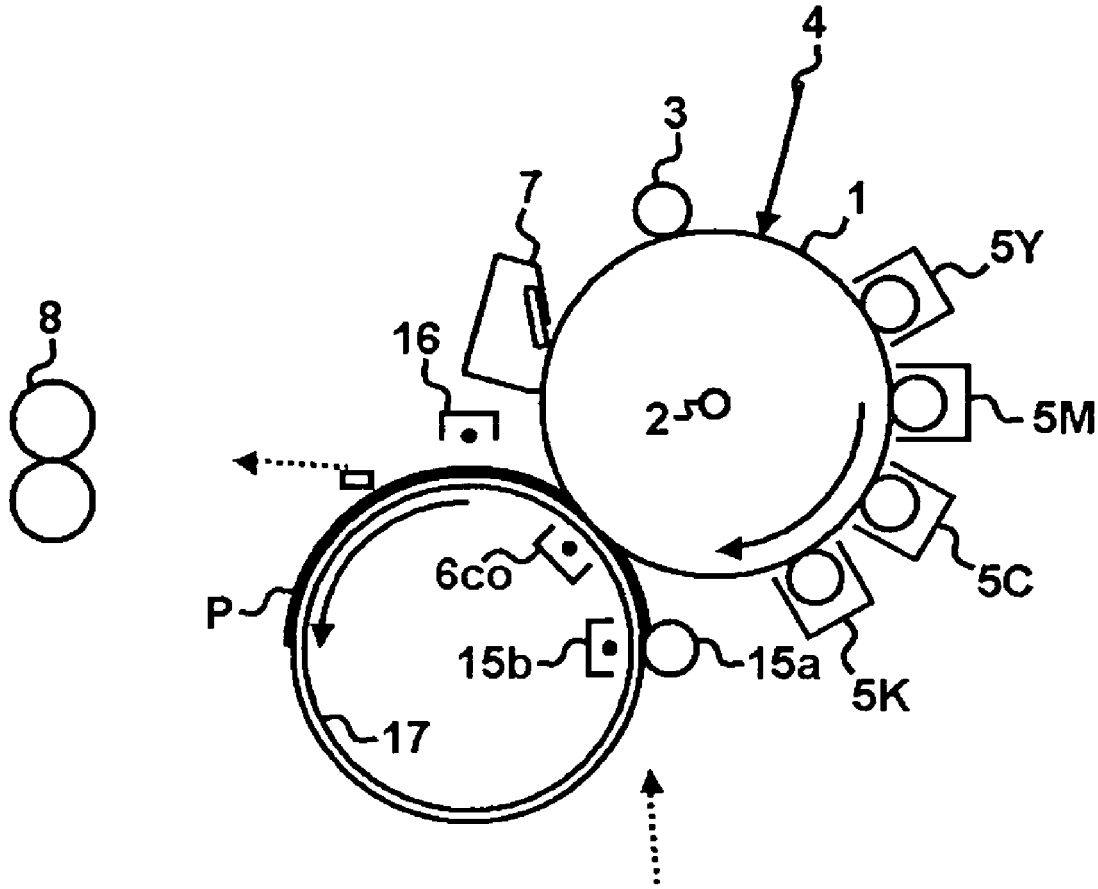
FIG. 7 is a schematic view showing an example of the construction of a color electrophotographic apparatus of a multiple-transfer system.

FIG. 7 schematically illustrates an example of the construction of the color electrophotographic apparatus of a multiple-transfer system. In the case of the multiple-transfer system, its transfer means is chiefly constituted of a transfer material carrying member and a transfer charging assembly.

In FIG. 7, reference numeral 1 denotes a cylindrical electrophotographic photosensitive member, which is rotatingly driven around an axis 2 in the direction of an arrow shown in FIG. 7 at a stated peripheral speed. Fitting members (drive members and/or bearing members) are also fitted (not shown) to the both ends of the electrophotographic photosensitive member 1 in order to drive the electrophotographic photosensitive member 1 rotatingly, and the electrophotographic photosensitive member 1 and the fitting members constitute an electrophotographic photosensitive member unit.

The surface of the electrophotographic photosensitive member 1 rotatingly driven is uniformly electrostatically charged to a positive or negative, given potential through a charging means (primary charging means) 3. The electrophotographic photosensitive member thus charged is then exposed to exposure light (imagewise exposure light) 4 emitted from an exposure means (not shown) for slit exposure, laser beam scanning exposure or the like. Here, the exposure light is exposure light corresponding to a first-color component image (e.g., a yellow component image) of an intended color image. In this way, first-color component electrostatic latent images (yellow component electrostatic latent images) corresponding to the first-color component image of the intended color image are successively formed on the surface of the electrophotographic photosensitive member 1.

A transfer material carrying member (transfer drum) 17 is rotatingly driven in the direction of an arrow shown in FIG. 7 at substantially the same peripheral speed as the electrophotographic photosensitive member 1 (e.g., 97% to 103% with respect to the peripheral speed of the electrophotographic photosensitive member 1). Also, a transfer material (such as paper) P fed from a transfer material feed means (not shown) is electrostatically held on (attracted to) the transfer material carrying member 17 and is transported to the part (contact zone) between the intermediate transfer member 11 and the transfer material carrying member.

The first color-component electrostatic latent images thus formed on the surface of the electrophotographic photosensitive member 1 are developed with a first-color toner (yellow toner) contained in a developer of a developing means 5Y (yellow component developing means), to form first-color toner images (yellow toner images). Then, the first-color toner images thus formed and held on the surface of the electrophotographic photosensitive member 1 are transferred by applying a transfer bias from a transfer charging assembly 6*co*, which are transferred onto the transfer material P held on the transfer material carrying member 17 which passes the part between the electrophotographic photosensitive member 1 and the transfer charging assembly 6*co*.

The surface of the electrophotographic photosensitive member 1 from which the first-color toner images have been transferred has removed therefrom, the developer (toner) remaining after the transfer, through a cleaning means 7. Thus, the surface is cleaned, and thereafter the electrophotographic photosensitive member 1 is used for the formation of a next-color image.

Second-color toner images (magenta toner images), third-color toner images (cyan toner images) and fourth-color toner images (black toner images) are also formed on the surface of the electrophotographic photosensitive member 1 in the same manner as the first-color toner images, and the second-color toner images (magenta toner images), the third-color toner images (cyan toner images) and the fourth-color toner images (black toner images) are transferred in order, to the transfer material P which is held on the transfer material carrying member 17 and to which the first-color toner images have been transferred. In this way, synthesized toner images corresponding to the intended color image are formed on the transfer material P held on the transfer material carrying member 17.

The transfer material P on which the synthesized toner images have been formed is separated from the surface of the transfer material carrying member 17, is led through a fixing means 8, where the toner images are fixed, and is then put out of the apparatus as a color-image-formed material (a print or copy).

The surface of the electrophotographic photosensitive member 1 from which the developers (toners) remaining after the transfer have been removed by a cleaning means 7 may also be subjected to charge elimination by pre-exposure light emitted from a pre-exposure means. Where as shown in FIG. 7 the charging means 3 is a contact charging means making use of a charging roller or the like, the pre-exposure is not necessarily required.

Incidentally, in FIG. 7, reference numeral 15*a* denotes an attraction roller for attracting the transfer material to the transfer material carrying member; 15*b* denotes an attraction charging assembly for charging the transfer material attracted to the transfer material carrying member; and the device also includes a separation charging assembly for separating the transfer material from the transfer material carrying member.

In the color electrophotographic apparatus constructed as shown in FIGS. 5 to 7 as well, like the electrophotographic apparatus constructed as shown in FIG. 4, the apparatus may be constituted of a combination of plural components integrally joined in a container as a process cartridge from among the constituents, such as the electrophotographic photosensitive member unit, the charging means, the developing means, the transfer means and the cleaning means so that the process cartridge is set detachably mountable to the main body of an electrophotographic apparatus, such as a copying machine or a laser beam printer.

EXAMPLES

The present invention is described below in greater detail by giving specific working examples. The present invention, however, is by no means limited to these. In the following Examples, "part(s)" refers to "part(s) by weight."

Example 1

Figure 8:
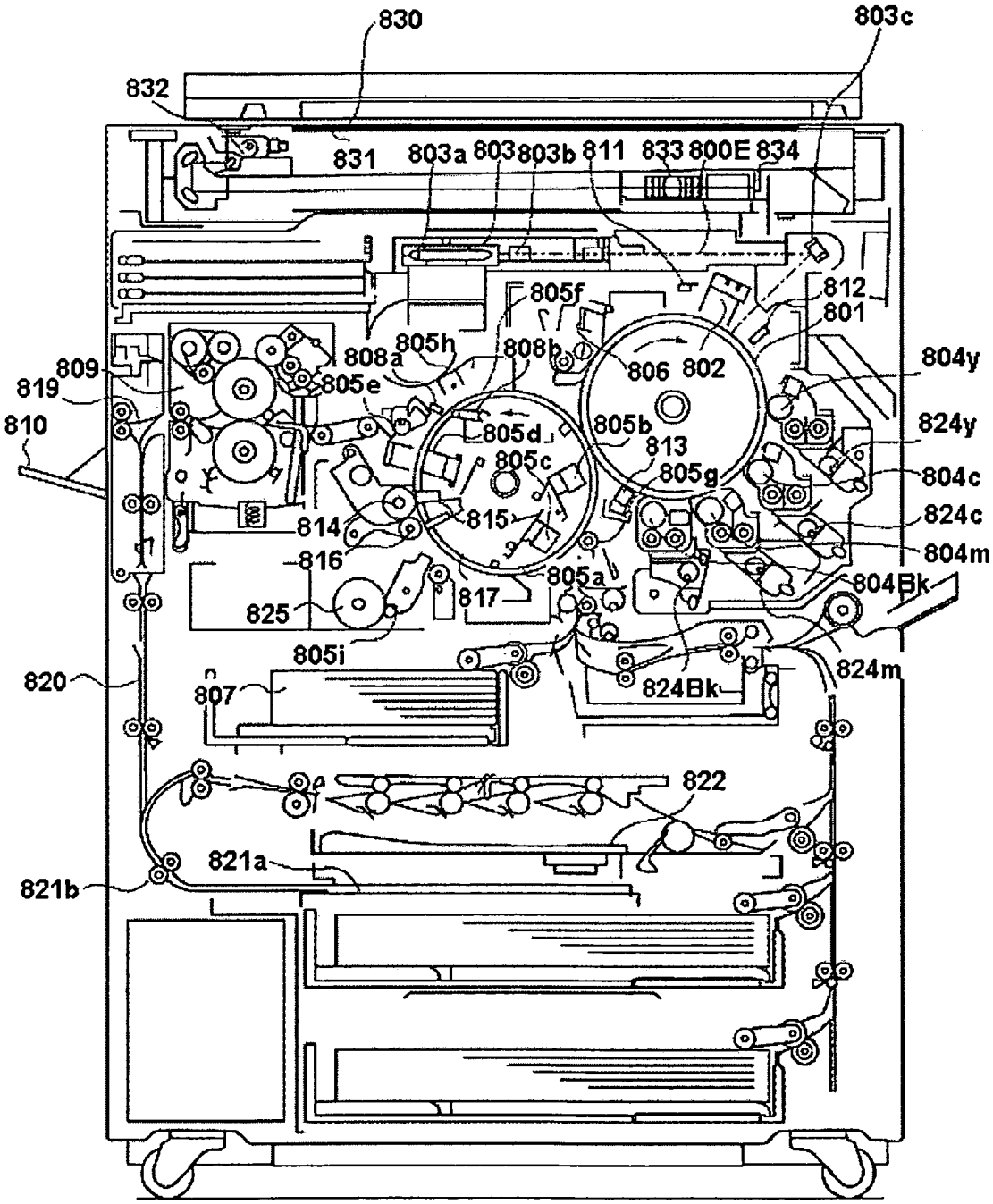
FIG. 8 is a schematic view showing an example of the construction of a full-color electrophotographic apparatus used in Examples 1 to 5.

FIG. 8 schematically illustrates the construction of a full-color electrophotographic apparatus used in the present working examples.

The full-color electrophotographic apparatus constructed as shown in FIG. 8 has a digital full-color-image reader section at the top and a digital full-color-image printer section at a lower part.

In the reader section, an original 830 is placed on an original-setting glass 831, and an exposure lamp 832 is put into exposure scanning mode, whereby an optical image reflected from the original 830 is focused on a full-color sensor 834 through a lens 833 to obtain full-color color separation image signals. The full color color separation image signals are processed by a video processing unit (not shown) through an amplifying circuit (not shown), and then forwarded to the printer section.

In the printer section, reference numeral 801 denotes an electrophotographic photosensitive member (an electrophotographic photosensitive member referred to later) 801, and is supported rotatably in the direction of an arrow shown in FIG. 8 inside member 801. Around the electrophotographic photosensitive member 801, provided are a pre-exposure lamp 811 (having twelve fuse lamps, six lamps in series and two lamps in parallel; capable of cutting light of 550 nm or less with a filter; a pre-exposure means), a corona charging assembly 802 (a charging means), a laser exposure optical system 803 (having a GaN type chip of 405 nm in oscillation wavelength and 5 mW in output, manufactured by Nichia Kagaku Kogyo K.K.; an exposure means), a potential sensor 812, a yellow developing assembly 804*y*, a cyan developing assembly 804*c*, a magenta developing assembly 804*m* and a black developing assembly 804Bk (developing means), a detector 813 for detecting the amount of light on the surface of the electrophotographic photosensitive member, a transfer means, and a cleaner 806. The developing assemblies 804*y*, 804*c*, 804*m* and 804Bk each have a developing sleeve.

In the laser exposure optical system 803, the image signals sent from the reader section are converted in a laser output section (not shown) into optical signals for image scanning exposure, and the laser beam thus converted is reflected on a polygonal mirror 803*a* and projected on the surface of the electrophotographic photosensitive member 801 through a lens 803*b* and a mirror 803*c*. The writing pitch is set to 600 dpi; and the beam spot diameter is set to 32 μm (spot diameter in the primary scanning direction is 28 μm, and spot diameter in the secondary scanning direction is 36 μm).

At the time of image formation in the printer section, the electrophotographic photosensitive member 801 is rotated in the direction of the arrow shown inside member 801 in FIG. 8. The electrophotographic photosensitive member 801 is, after destaticized by the pre exposure lamp 811, uniformly negatively electrostatically charged by means of the corona charging assembly 802, and then irradiated with an optical image 800E for each separated color to form electrostatic images on the surface of the electrophotographic photosensitive member 801.

Next, a stated developing assembly is operated to develop the electrostatic images formed on the surface of the electrophotographic photosensitive member 801 to form developed images on the surface of the electrophotographic photosensitive member 801 by the use of a two-component developer (making use of a negative toner). The developing assemblies are so set as to alternatively come close to the electrophotographic photosensitive member 801 in accordance with the respective separated colors by the operation of eccentric cams 824*y*, 824*c*, 824*m* and 824Bk.

Developed images held on the surface of the electrophotographic photosensitive member 801 are further transferred, through a transport system and a transfer means, to a sheet of paper fed from a transfer material cassette 807 in which sheets of paper (transfer materials) are kept held, to the position facing the electrophotographic photosensitive member 801.

The transfer means has a transfer drum 805*a*, a transfer charging assembly 805*b*, an attraction charging assembly 805*c* for attracting a sheet of paper electrostatically, an attraction roller 805*g* provided opposingly thereto, an inside charging assembly 805*d*, and an outside charging assembly 805*e*. The transfer drum 805*a*, which is supported on a shaft so that it can be rotatably driven, has a transfer material holding sheet 805*f* stretched integrally in a cylindrical form at an open zone on the periphery thereof. As the transfer material holding sheet 805*f*, a dielectric sheet polycarbonate film is used.

As the transfer drum 805*a* is rotated, the developed images on the surface of the electrophotographic photosensitive member 801 are transferred to the sheet of paper held on the transfer material holding sheet 805*f* of the transfer drum 805*a*.

In this way, a desired number of color images are transferred to the sheet of paper held on the transfer material holding sheet 805*f* of the transfer drum 805*a*, thus forming a full color image is formed.

In the case when the full-color image is formed, the transfer of four-color developed images is thus completed, whereupon the sheet of paper is separated from the transfer drum 805*a* by the action of a separation claw 808*a*, a separation push-up roller 808*b* and a separation charging assembly 805*h*, and outputted to a tray 810 via a heat roller fixing assembly 809.

Meanwhile, the electrophotographic photosensitive member 801 is cleaned by removing with a cleaner 806 the toners remaining on the surface, and thereafter again undergoing the steps of image formation.

When the image is formed on the both sides of the sheet of paper, immediately after the sheet of paper has been delivered out of the heat roller fixing assembly 809, a transport path switch guide 819 is driven to first guide the paper to a reverse path 821*a* via a transport vertical path 820, and then reverse rollers 821*b* are rotated in reverse so that the sheet of paper is withdrawn in the direction opposite to the direction in which it has been sent into the rollers, with its leading end first, which had been the rear end when sent into the rollers, and is received in an intermediate tray 822. Thereafter, an image is formed again on the other side through the image formation steps described above.

In order to, e.g., prevent powder from scattering and adhering onto the transfer material holding sheet 805*f* of the transfer drum 805*a* and prevent oil from adhering onto the paper, cleaning is also performed by the action of a fur brush 814 and a back-up brush 815 set to be opposed to the fur brush 814 via the transfer material holding sheet 805*f*, and an oil removing roller 816 and a back-up brush 817 to be opposed to the oil-removing roller 816 via the transfer material holding sheet 805*f*. Such cleaning may be performed before the image formation or after the image formation, or may be performed at any time when a paper jam occurs.

An eccentric cam 825 is also operated at desired timing to actuate a cam follower 805*i* associated with the transfer drum 805*a*, whereby the gap between the transfer material holding sheet 805*f* and the electrophotographic photosensitive member 801 can be set as desired. For example, during the time the device is in a stand-by state or at the time of power-off, a space is kept between the transfer drum 805*a* and the electrophotographic photosensitive member 801.

The electrophotographic photosensitive member used in this Example was produced by the following procedure.

A machined aluminum cylinder of 10 μm in cylinder deflection, 360 μm in length, 180 mm in diameter and 0.4 μm in ten point average roughness Rz JIS (available from Furukawa Denki Kogyo K.K.) was used as a support.

Incidentally, in the present invention, the ten point average roughness Rz jis was measured according to JIS B0601 (2001) by means of SURFCOADER SE-3500 (manufactured by Kosaka Laboratory Ltd.), setting the cut off to 0.8 mm and measurement length to 8 mm.

Next, 50 parts of conductive titanium oxide particles coated with tin oxide containing 10% of antimony oxide, 25 parts of phenol resin, 20 parts of methyl cellosolve, 50 parts of methanol and 0.002 part of silicone oil (polydimethylsiloxane-polyoxyalkylene copolymer; number average molecular weight: 3,000) were subjected to dispersion for 2 hours by means of a sand mill making use of glass beads of 1 mm in diameter, to prepare a conductive layer coating dispersion.

This conductive layer coating dispersion was dip coated on the support, followed by drying at 140° C. for 30 minutes to form a conductive layer with a layer thickness of 15 μm.

Next, 30 parts of methoxymethylated nylon resin (number-average molecular weight: 32,000) and 10 parts of an alcohol soluble copolymer nylon resin (number average molecular weight: 29,000) were dissolved with a mixed solvent of 260 parts of methanol and 40 parts of butanol to prepare an intermediate layer coating solution.

This intermediate layer coating solution was dip-coated on the conductive layer, followed by drying to form an intermediate layer with a layer thickness of 1 μm.

Next, 10 parts of hydroxygallium phthalocyanine of a crystal form having strong peaks at 7.5°, 9.9°, 16.3°, 18.6°, 25.1° and 28.3° of Bragg's angle (2θ±0.2°) in the CuKα characteristic X-ray diffraction, 5 parts of polyvinyl butyral (trade name: S-LEC BX-1; available from Sekisui Chemical Co., Ltd.) and 250 parts of cyclohexanone were subjected to dispersion for 3 hours by means of a sand mill making use of glass beads of 1 mm in diameter, followed by addition of 250 parts of ethyl acetate to prepare a charge generation layer coating dispersion.

This charge generation layer coating dispersion was dip-coated on the intermediate layer, followed by drying at 100° C. for 10 minutes to form a charge generation layer with a layer thickness of 0.25 μm.

Next, 7 parts of a charge transporting material (A) with a structure represented by the following formula:

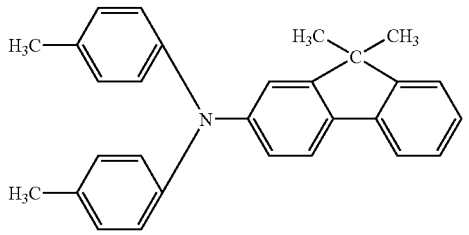

and 10 parts of polycarbonate resin (trade name: IUPILON Z-400; available from Mitsubishi Gas Chemical Company, Inc.) were dissolved in 70 parts of monochlorobenzene to prepare a charge transport layer coating solution.

This charge transport layer coating solution was dip coated on the charge generation layer, followed by drying at 110° C. for 1 hour to form a charge transport layer with a layer thickness of 13 μm.

Thus, a cylindrical electrophotographic photosensitive member was produced the charge transport layer of which was the surface layer.

Next, to both ends of the electrophotographic photosensitive member produced, flanges were fitted for rotational driving to make up an electrophotographic photosensitive member unit. The cylinder deflection (De) of this electrophotographic photosensitive member unit was 15 μm.

This electrophotographic photosensitive member unit was set in the full-color electrophotographic apparatus constructed as shown in FIG. 8, and full-color images were reproduced. The full-color images reproduced were visually evaluated. Incidentally, dark-area potential (charge potential) was so set as to be −700 V, light-area potential −200 V, and development bias −550 V.

The results of evaluation are shown in Table 1. Incidentally, in Table 1, the evaluation criteria of roughness (coarseness or non-uniformity of halftone images) and color misregistration are as follows:

AA: Not seen.

A: Almost not seen.

B: Seen, though not conspicuous.

C: Seen.

D: Conspicuous.

E: Very conspicuous.

Example 2

In Example 1, an electrophotographic photosensitive member was produced in the same manner as in Example 1, except that the support was changed for a machined aluminum cylinder of 19 μm in cylinder deflection, 360 mm in length, 180 mm in diameter and 0.5 μm in ten point average roughness Rz JIS (available from Furukawa Denki Kogyo K.K.). To both ends of the electrophotographic photosensitive member produced, flanges were fitted for rotational driving to make up an electrophotographic photosensitive member unit. The cylinder deflection (De) of this electrophotographic photosensitive member unit was 27 μm.

In the same manner as in Example 1, this electrophotographic photosensitive member unit was set in the full-color electrophotographic apparatus constructed as shown in FIG. 8, and full-color images were reproduced, where the full-color images reproduced were visually evaluated. The results of evaluation are shown in Table 1.

Example 3

In Example 1, layers up to the charge generation layer of the electrophotographic photosensitive member were formed in the same manner as in Example 1, except that the support was changed for a machined aluminum cylinder of 31 μm in cylinder deflection, 360 mm in length, 180 mm in diameter and 0.5 μm in ten-point average roughness Rz JIS (available from Furukawa Denki Kogyo K.K.).

Next, 6 parts of a charge-transporting material (A) with a structure represented by the following formula:

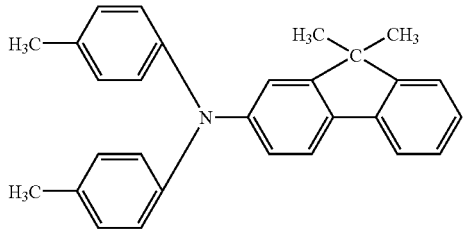

1 part of a charge-transporting material (B) with a structure represented by the following formula:

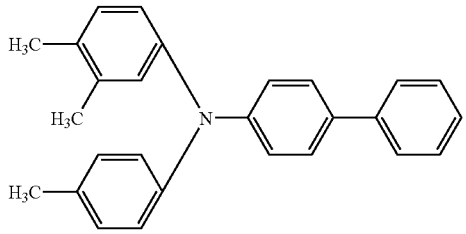

and 10 parts of polycarbonate resin (trade name: IUPILON Z-200; available from Mitsubishi Gas Chemical Company, Inc.) were dissolved in 60 parts of monochlorobenzene to prepare a charge transport layer (first charge transport layer) coating solution.

This charge transport layer (first charge transport layer) coating solution was dip-coated on the charge generation layer, followed by drying at 110° C. for 1 hour to form a charge transport layer (first charge transport layer) with a layer thickness of 10 μm.

Next, 3 parts of polytetrafluoroethylene resin particles (trade name: LUBRON L-2; available from Daikin Industries, Ltd.), 6 parts of polycarbonate resin (trade name: IUPILON Z-800), 0.24 part of comb fluorine type graft polymer (trade name: GF300; available from Toagosei Chemical Industry Co., Ltd.), 120 parts of monochlorobenzene and 80 parts of methylal were subjected to dispersion mixing by means of an ultra-high dispersion machine. In the dispersion obtained, 3 parts of the charge transporting material (A) with a structure represented by the following formula:

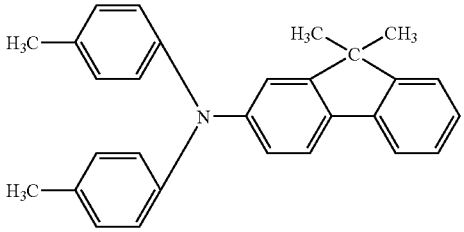

was dissolved to prepare a protective layer (second charge transport layer) coating dispersion.

This protective layer (second charge transport layer) coating dispersion was spray-coated on the charge transport layer (first charge transport layer), followed by drying at 80° C. for 10 minutes, and then drying at 120° C. for 50 minutes. Thereafter, the surface was polished for 1 minute with use of a polishing sheet (lapping tape; abrasive particles: alumina; abrasive particle diameter: #3000; available from Fuji Photo Film Co., Ltd.) to form a protective layer (second charge transport layer) with a layer thickness of 3 μm and a ten point average roughness Rz JIS of 0.7 μm.

Thus, a cylindrical electrophotographic photosensitive member was produced the protective layer (second charge transport layer) of which was the surface layer.

Next, to both ends of the electrophotographic photosensitive member produced, flanges were fitted for rotational driving to make up an electrophotographic photosensitive member unit. The cylinder deflection (De) of this electrophotographic photosensitive member unit was 40 μm.

In the same manner as in Example 1, this electrophotographic photosensitive member unit was set in the full-color electrophotographic apparatus constructed as shown in FIG. 8, and full-color images were reproduced, where the full color images reproduced were visually evaluated. The results of evaluation are shown in Table 1.

Example 4

In Example 2, an electrophotographic photosensitive member was produced in the same manner as in Example 2 except that the hydroxygallium phthalocyanine was changed for an azo pigment with a structure represented by the following formula:

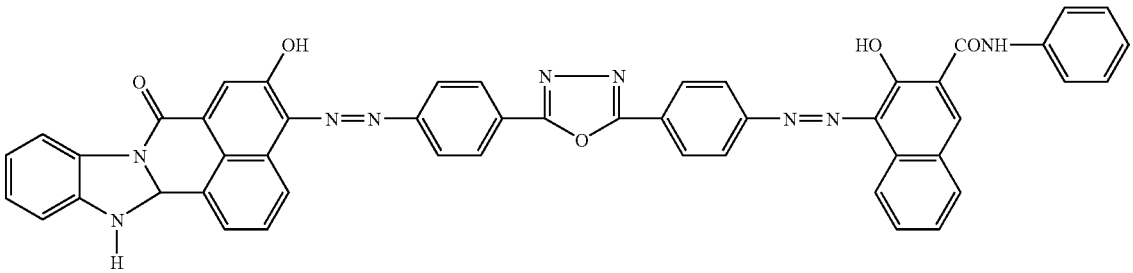

To both ends of the electrophotographic photosensitive member produced, flanges were fitted for rotational driving to make up an electrophotographic photosensitive member unit. The cylinder deflection (De) of this electrophotographic photosensitive member unit was 28 μm.

In the same manner as in Example 2, this electrophotographic photosensitive member unit was set in the full-color electrophotographic apparatus constructed as shown in FIG. 8, and full-color images were reproduced, where the full-color images reproduced were visually evaluated. The results of evaluation are shown in Table 1.

Comparative Example 1

In Example 1, an electrophotographic photosensitive member was produced in the same manner as in Example 1 except that the support was changed for a machined aluminum cylinder of 50 μm in cylinder deflection, 360 mm in length, 180 mm in diameter and 0.6 μm in ten point average roughness Rz JIS (available from Furukawa Denki Kogyo K.K.). To both ends of the electrophotographic photosensitive member produced, flanges were fitted for rotational driving to make up an electrophotographic photosensitive member unit. The cylinder deflection (De) of this electrophotographic photosensitive member unit was 60 μm.

In the same manner as in Example 1, this electrophotographic photosensitive member unit was set in the full-color electrophotographic apparatus constructed as shown in FIG. 8, and full-color images were reproduced, where the full-color images reproduced were visually evaluated. The results of evaluation are shown in Table 1.

Comparative Example 2

In Example 1, an electrophotographic photosensitive member was produced in the same manner as in Example 1 except that the support was changed for a machined aluminum cylinder of 70 μm in cylinder deflection, 360 mm in length, 180 mm in diameter and 0.2 μm in ten point average roughness Rz JIS (available from Furukawa Denki Kogyo K.K.). To both ends of the electrophotographic photosensitive member produced, flanges were fitted for rotational driving to make up an electrophotographic photosensitive member unit. The cylinder deflection (De) of this electrophotographic photosensitive member unit was 90 μm.

In the same manner as in Example 1, this electrophotographic photosensitive member unit was set in the full-color electrophotographic apparatus constructed as shown in FIG. 8, and full-color images were reproduced, where the full-color images reproduced were visually evaluated. The results of evaluation are shown in Table 1.

Comparative Example 3

In Example 3, an electrophotographic photosensitive member and an electrophotographic photosensitive member unit were produced in the same manner as in Example 3, except that the beam spot diameter was set to 25 μm (spot diameter in the primary scanning direction was 22 μm, and spot diameter in the secondary scanning direction was 28 μm). The evaluation was made in the same way. The results of evaluation are shown in Table 1.

Example 5

In Comparative Example 3, the electrophotographic photosensitive member and the electrophotographic photosensitive member unit were changed for an electrophotographic photosensitive member and an electrophotographic photosensitive member unit which were produced in the same manner as in Example 2. The evaluation was made in the same manner as in Comparative Example 3. The results of the evaluation are shown in Table 1.

Comparative Example 4

In Example 3, an electrophotographic photosensitive member and an electrophotographic photosensitive member unit were produced in the same manner as in Example 3, except that the GaN type chip the laser exposure optical system 803 of the full color electrophotographic apparatus used in evaluation had was changed to an AlGaInP type chip (oscillation wavelength: 670 nm) and also that the beam spot diameter was set to 60 μm (spot diameter in the primary scanning direction was 55 μm, and the spot diameter in the secondary scanning direction was 65 elm). The evaluation was made in the same way. The results of evaluation are shown in Table 1.

Example 6

In Example 1, an electrophotographic photosensitive member was produced in the same manner as in Example 1 except that the support was changed for a drawn aluminum cylinder of 15 μm in cylinder deflection, 360 mm in length, 30 mm in diameter and 0.8 μm in ten point average roughness Rz JIS (available from Showa Aluminum Corporation). To both ends of the electrophotographic photosensitive member produced, flanges were fitted for rotational driving to make up an electrophotographic photosensitive member unit. The cylinder deflection (De) of this electrophotographic photosensitive member unit was 21 μm.

Figure 9:
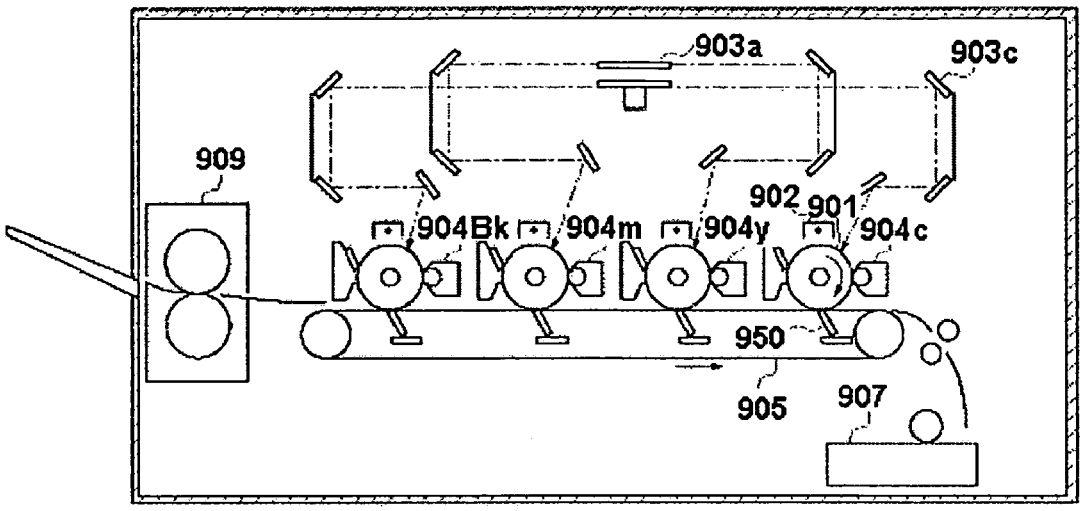
FIG. 9 is a schematic view showing an example of the construction of a full-color electrophotographic apparatus used in Examples 6 and 7.

This electrophotographic photosensitive member unit was set in a full color electrophotographic apparatus constructed as shown in FIG. 9 (in-line system), and full-color images were reproduced, where the full-color images reproduced were visually evaluated in the same manner as in Example 1. The results of evaluation are shown in Table 1.

Incidentally, the laser exposure optical system of the full-color electrophotographic apparatus constructed as shown in FIG. 9 has a GaN type chip of 405 nm in oscillation wavelength and 5 mW in output, (manufactured by Nichia Kagaku Kogyo K.K.). Also, the writing pitch was set to 400 dpi; and the beam spot diameter, 31 μm (spot diameter in the primary scanning direction: 28 μm, and spot diameter in the secondary scanning direction: 34 μm).

In FIG. 9, reference numeral 901 denotes an electrophotographic photosensitive member; 902 denotes a corona charging assembly; 903*a* denotes a polygon mirror; 903*c* denotes a mirror; 904*c*, 904*y*, 904*m* and 904Bk denote developing assemblies; 905 denotes a transfer material transport belt; 950 denotes a transfer charging assembly; 907 denotes a transfer material cassette; and 909 denotes a fixing assembly.

Example 7

In Example 6, layers up to the charge transport layer (first charge transport layer) were formed in the same manner as in Example 6 except that the layer thickness of the charge transport layer (first charge transport layer) was changed to 10 μm.

Next, 36 parts of a charge-transporting material (C) with a structure represented by the following formula:

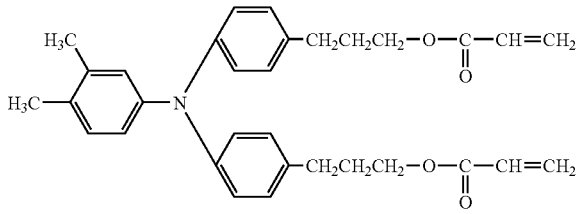

4 parts of polytetrafluoroethylene resin particles (trade name: LUBRON L-2; available from Daikin Industries, Ltd.) and 60 parts n-propyl alcohol were subjected to dispersion by means of an ultra high dispersion machine to prepare a protective layer (second charge transport layer) coating dispersion.

This protective layer (second charge transport layer) coating dispersion was dip-coated on the charge transport layer (first charge transport layer), followed by irradiation with electron rays in an atmosphere of nitrogen under conditions of an accelerating voltage of 150 kV and a dose of 1.5 Mrad, and then heat treatment for 3 minutes under conditions that the temperature of the electrophotographic photosensitive member came to be 120° C. (here, oxygen concentration was 20 ppm). Then, the resultant electrophotographic photosensitive member was post-treated at 110° C. for 1 hour in the atmosphere to form a protective layer (second charge transport layer) with a layer thickness of 5 μm.

Thus, a cylindrical electrophotographic photosensitive member was produced the protective layer (second charge transport layer) of which was the surface layer.

Next, to both ends of the electrophotographic photosensitive member produced, flanges were fitted for rotational driving to make up an electrophotographic photosensitive member unit. The cylinder deflection (De) of this electrophotographic photosensitive member unit was 26 μm.

This electrophotographic photosensitive member unit was evaluated in the same manner as in Example 6. The results of the evaluation are shown in Table 1.

Comparative Example 5

In Example 6, an electrophotographic photosensitive member and an electrophotographic photosensitive member unit were produced in the same manner as in Example 6 except that the GaN type chip the laser exposure optical system of the full-color electrophotographic apparatus used in evaluation had was changed to a GaA1As type chip (oscillation wavelength: 780 nm) and also that the beam spot diameter was set to 56 μm (spot diameter in the primary scanning direction was 48 μm, and spot diameter in the secondary scanning direction was 64 μm). An evaluation was made in the same way. The results of evaluation are shown in Table 1.

Comparative Example 6

In Comparative Example 5, an electrophotographic photosensitive member and an electrophotographic photosensitive member unit were produced in the same manner as in Comparative Example 5 except that the writing pitch of the full-color electrophotographic apparatus used in the evaluation was set to 600 dpi. An evaluation was made in the same way. The results of evaluation are shown in Table 1.

TABLE 1

| | Evaluation apparatus | Oscillation wavelength (nm) | Di (μm) | De (μm) | De/Di | Roughness* | Color misregistration | Resolution |
|---|---|---|---|---|---|---|---|---|
| Example: | | | | | | | | |
| 1 | FIG. 8 | 405 | 32 | 15 | 0.47 | AA | AA | Ultra-high. |
| 2 | " | " | " | 27 | 0.84 | A | AA | Ultra-high. |
| 3 | " | " | " | 40 | 1.25 | A | A | Ultra-high. |
| 4 | " | " | " | 28 | 0.88 | A | AA | Ultra-high. |
| Comparative Example: | | | | | | | | |
| 1 | " | " | " | 60 | 1.88 | D | C | — |
| 2 | " | " | " | 90 | 2.81 | E | D | — |
| 3 | " | " | 25 | 40 | 1.60 | B | A | Ultra high. |
| Example: | | | | | | | | |
| 5 | " | " | " | 27 | 1.08 | A | A | Ultra-high. |
| Comparative Example: | | | | | | | | |
| 4 | " | 670 | 60 | 40 | 0.67 | B | A | Inferior to Ex. 3. |

TABLE 1-continued

| | Evaluation apparatus | Oscillation wavelength (nm) | Di (μm) | De (μm) | De/Di | Roughness* | Color misregistration | Resolution |
|---|---|---|---|---|---|---|---|---|
| Example: | | | | | | | | |
| 6 | FIG. 9 | 405 | 31 | 21 | 0.68 | AA | AA | Ultra-high. |
| 7 | " | " | " | 26 | 0.84 | A | AA | Ultra-high. |
| Comparative Example: | | | | | | | | |
| 5 | " | 780 | 56 | 21 | 0.38 | B | A | Inferior to Ex. 6. |
| 6 | " | " | " | 21 | 0.38 | B | A | Inferior to Ex. 6. |

*(coarseness or non-uniformity of halftone images)

Thus, according to the present invention, it can provide, in the electrophotographic apparatus in which the beam spot has been made to have a small spot diameter by the use of the laser having an oscillation wavelength within the range of from 380 nm to 450 nm, an electrophotographic photosensitive apparatus that enables image reproduction at ultra-high resolution and in ultra-high image quality, and also can provide a process cartridge and an electrophotographic photosensitive member unit which are used in such an electrophotographic apparatus.

The invention claimed is:

1. An electrophotographic apparatus comprising:

I) an electrophotographic photosensitive member unit comprising:

i) an electrophotographic photosensitive member comprising:

a cylindrical support; and a photosensitive layer provided on said cylindrical support; and ii) fitting members configured and positioned to drive said electrophotographic photosensitive member rotatingly in said electrophotographic apparatus and fitted to end portions of said electrophotographic photosensitive member; and II) an exposure device comprising a laser having an oscillation wavelength within the range of from 380 nm to 450 nm, wherein the spot diameter Di of a beam spot formed on the surface of said electrophotographic photosensitive member by a laser beam emitted from said laser is 40 μm or less, wherein the spot diameter Di of the beam spot formed on the surface of said electrophotographic photosensitive member by the laser beam emitted from said laser is an average value of a primary scanning direction spot diameter and a secondary scanning direction spot diameter, and wherein the cylinder deflection De of said electrophotographic photosensitive member unit is 0.68 times or less the spot diameter Di of the beam spot.

2. The electrophotographic apparatus according to claim 1, wherein the cylinder deflection De of said electrophotographic photosensitive member unit is 0.5 times or less the spot diameter Di of the beam spot.

3. An electrophotographic apparatus according to claim 1, wherein said fitting members are drive members or bearing members.

4. A process cartridge detachably mountable to an electrophotographic apparatus, said process cartridge comprising:

an electrophotographic photosensitive member unit comprising:

i) an electrophotographic photosensitive member comprising:

a cylindrical support; and a photosensitive layer provided on said cylindrical support; and ii) fitting members configured and positioned to drive said electrophotographic photosensitive member rotatingly in the electrophotographic apparatus and fitted to end portions of said electrophotographic photosensitive member; and an exposure device comprising a laser having an oscillation wavelength within the range of from 380 nm to 450 nm, wherein the spot diameter Di of a beam spot formed on the surface of said electrophotographic photosensitive member by a laser beam emitted from said laser is 40 μm or less, wherein the spot diameter Di of the beam spot formed on the surface of said electrophotographic photosensitive member by the laser beam emitted from said laser is an average value of a primary scanning direction spot diameter and a secondary scanning direction spot diameter, and wherein the cylinder deflection De of said electrophotographic photosensitive member unit is 0.68 times or less the spot diameter Di of the beam spot.

5. The process cartridge according to claim 4, wherein the cylinder deflection De of said electrophotographic photosensitive member unit is 0.5 times or less the spot diameter Di of said beam spot.

6. A process cartridge according to claim 4, wherein said fitting members are drive members or bearing members.

* * * * *

UNITED STATES PATENT AND TRADEMARK OFFICE

CERTIFICATE OF CORRECTION

PATENT NO. : 7,071,962 B2
APPLICATION NO. : 10/842488
DATED : July 4, 2006
INVENTOR(S) : Atsushi Fujii et al.

It is certified that error appears in the above-identified patent and that said Letters Patent is hereby corrected as shown below:

COLUMN 14:
Line 66, “in line-system” should read --in-line system--.

COLUMN 18:
Line 21, “the for” should read --for the--.

COLUMN 22:
Line 17, “image is formed.” should read --image.--.

COLUMN 28:
Line 15, “had” should be deleted.
Line 19, “elm” should read --μm--.

COLUMN 30:
Line 17, “had” should be deleted.

Signed and Sealed this

Fifth Day of August, 2008

JON W. DUDAS
*Director of the United States Patent and Trademark Office*